US010403431B2

(12) United States Patent
Banba et al.

(10) Patent No.: US 10,403,431 B2
(45) Date of Patent: Sep. 3, 2019

(54) COIL COMPONENT, COIL MODULE, AND METHOD FOR MANUFACTURING COIL COMPONENT

(71) Applicant: Murata Manufacturing Co., Ltd., Kyoto (JP)

(72) Inventors: Shinichiro Banba, Kyoto (JP); Tsuneo Murata, Kyoto (JP); Norio Sakai, Kyoto (JP); Yoshihito Otsubo, Kyoto (JP); Keiichi Ichikawa, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 329 days.

(21) Appl. No.: 15/255,965

(22) Filed: Sep. 2, 2016

(65) Prior Publication Data

US 2016/0372259 A1 Dec. 22, 2016

Related U.S. Application Data

(63) Continuation of application No. PCT/JP2015/055628, filed on Feb. 26, 2015.

(30) Foreign Application Priority Data

Mar. 4, 2014 (JP) ..... 2014-041968

(51) Int. Cl.
*H01F 27/29* (2006.01)
*H01F 41/04* (2006.01)
(Continued)

(52) U.S. Cl.
CPC ..... *H01F 27/29* (2013.01); *H01F 17/062* (2013.01); *H01F 27/255* (2013.01);
(Continued)

(58) Field of Classification Search
CPC ..... H01F 5/00; H01F 27/00–36
(Continued)

(56) References Cited

U.S. PATENT DOCUMENTS 7,271,697 B2 * 9/2007 Whittaker ..... H01F 17/0033 336/229
7,821,374 B2 * 10/2010 Harrison ..... H01F 19/04 336/229
(Continued)

FOREIGN PATENT DOCUMENTS

JP S59-125811 U 8/1984
JP S61-237407 A 10/1986
(Continued)

OTHER PUBLICATIONS

International Search Report issued in Patent Application No. PCT/JP2015/055628 dated May 15, 2015.
(Continued)

*Primary Examiner* — Tuyen T Nguyen
(74) *Attorney, Agent, or Firm* — Pearne & Gordon LLP

(57) ABSTRACT

A coil component that includes a coil having a thick coil core and good inductance characteristics and is able to narrow the pitch of a coil electrode is provided. The wiring of a coil electrode in a direction across the direction of a winding axis of the coil electrode includes a plurality of first metal pins and a plurality of second metal pins. By elongating each metal pin, the wiring of the coil electrode is easily elongated in a metal pin direction. Thus, a coil core is easily thickened in the metal pin direction. The wiring of the coil electrode can be formed in the metal pin direction only by arranging the metal pins. Thus, it is possible to provide a coil component that includes a coil having the thick coil core and good inductance characteristics and is able to narrow the pitch of the coil electrode.

13 Claims, 12 Drawing Sheets

(51) Int. Cl.

| | |
|---|---|
| ***H01F 41/08*** | (2006.01) |
| ***H01F 17/06*** | (2006.01) |
| ***H01F 27/255*** | (2006.01) |
| ***H01F 27/28*** | (2006.01) |
| ***H01F 41/02*** | (2006.01) |

(52) U.S. Cl.
CPC ..... *H01F 27/2823* (2013.01); *H01F 41/02* (2013.01); *H01F 41/04* (2013.01); *H01F 41/08* (2013.01)

(58) Field of Classification Search
USPC ..... 336/65, 83, 192, 200, 225, 229, 232
See application file for complete search history.

(56) References Cited

U.S. PATENT DOCUMENTS 8,591,262 B2 * 11/2013 Schaffer ..... H01F 5/003 336/170
2009/0002111 A1 1/2009 Harrison et al.

FOREIGN PATENT DOCUMENTS

| | | | |
|---|---|---|---|
| JP | 2000040620 | A | 2/2000 |
| JP | 2001-068364 | A | 3/2001 |
| JP | 2010-516056 | A | 5/2010 |
| JP | 2013-058516 | A | 3/2013 |
| JP | 2013-207149 | A | 10/2013 |
| JP | 2013-207150 | A | 10/2013 |
| JP | 2013-207151 | A | 10/2013 |
| JP | 2014-038883 | A | 2/2014 |
| JP | 2014-038884 | A | 2/2014 |
| WO | 2010-106996 | A1 | 9/2010 |

OTHER PUBLICATIONS

Written Opinion issued in Patent Application No. PCT/JP2015/055628 dated May 15, 2015.

* cited by examiner

FIG. 3A
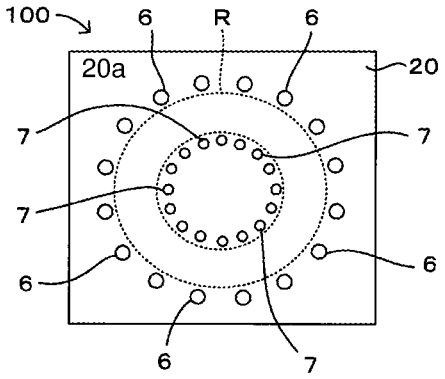
FIG. 3B
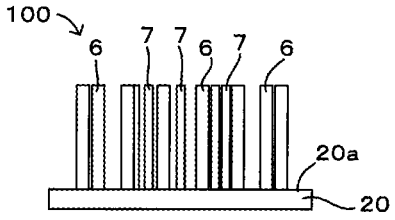
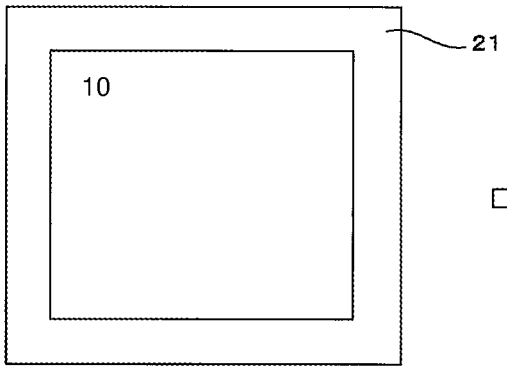
FIG. 4A
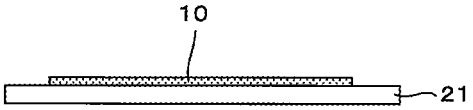
FIG. 4B
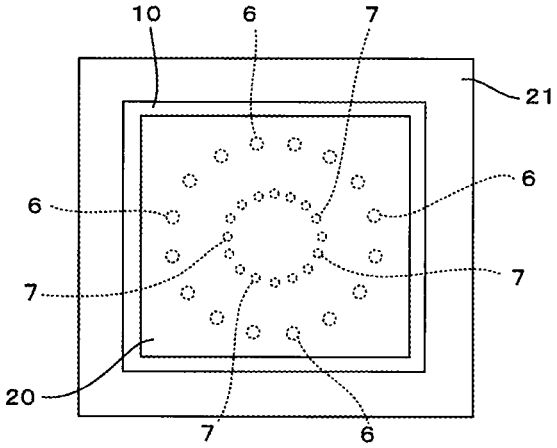
FIG. 5A
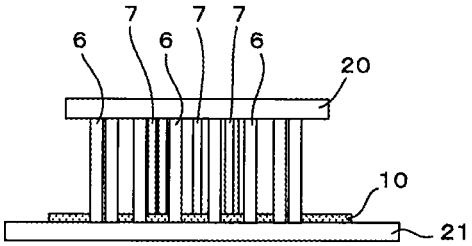
FIG. 5B FIG. 6A
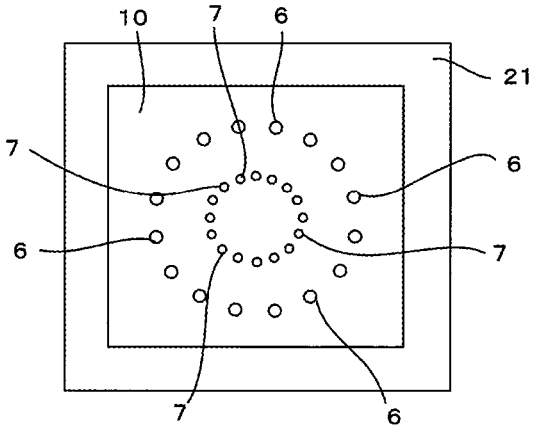
FIG. 6B
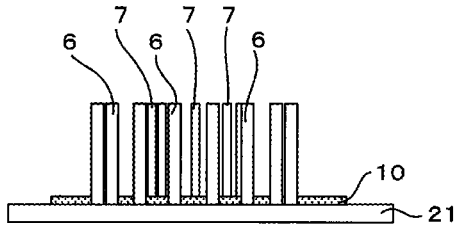
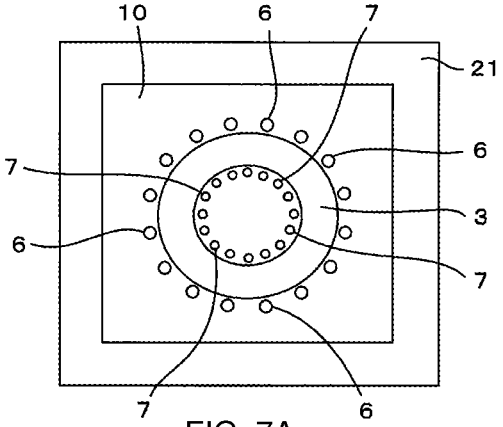
FIG. 7A
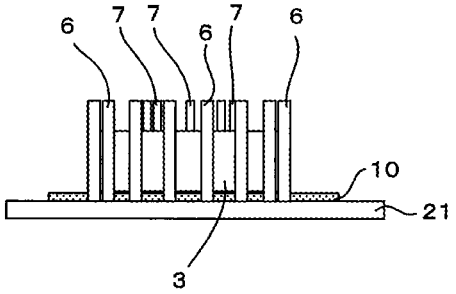
FIG. 7B
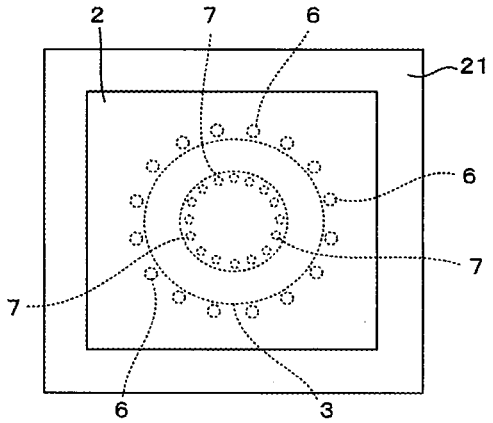
FIG. 8A
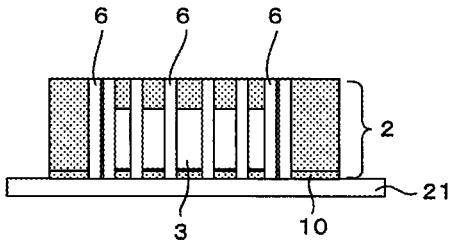
FIG. 8B

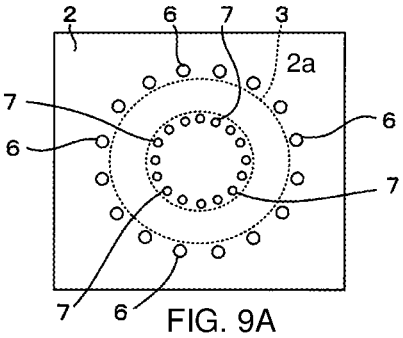
FIG. 9A
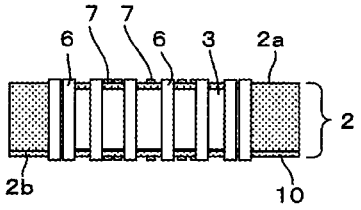
FIG. 9B
FIG. 10
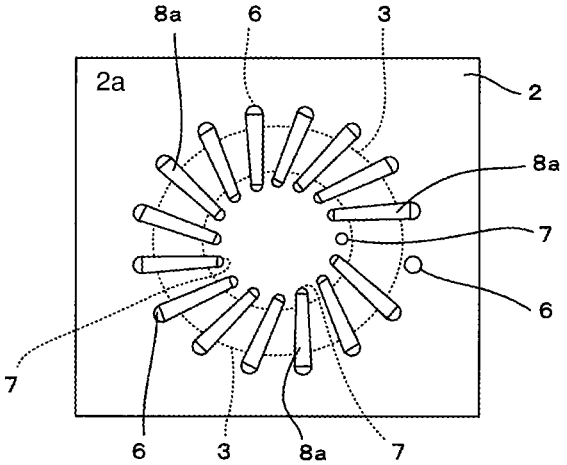
FIG. 11
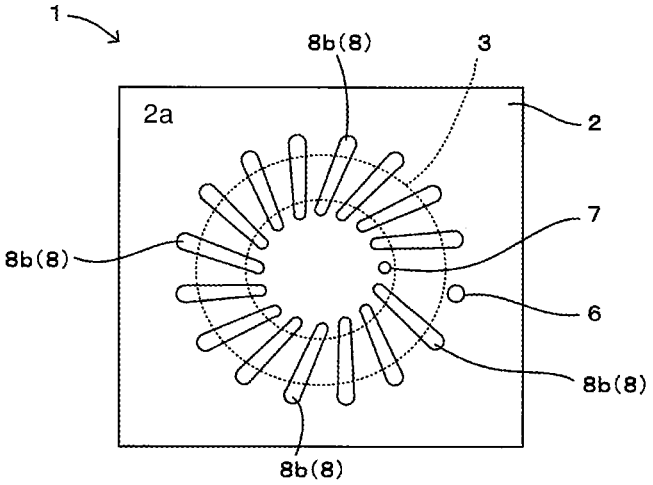

FIG. 22
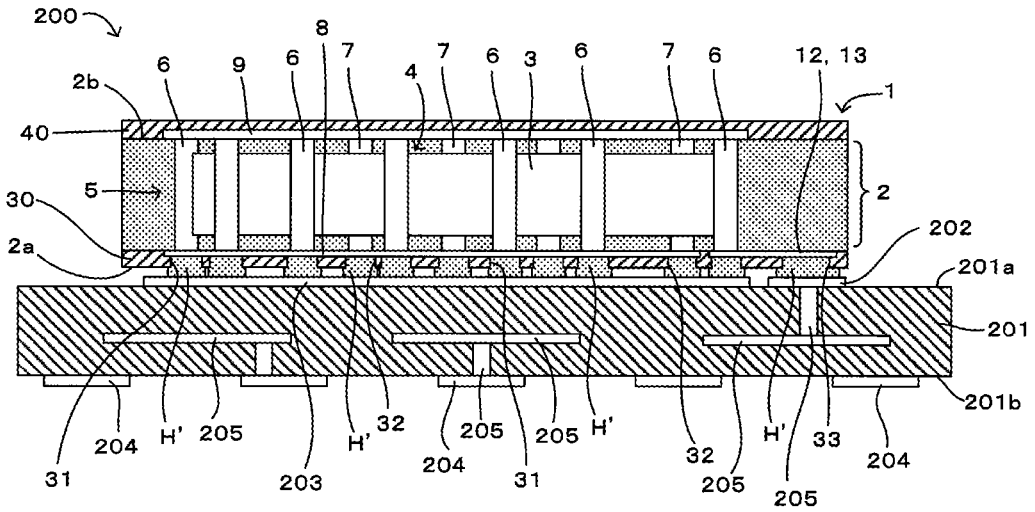
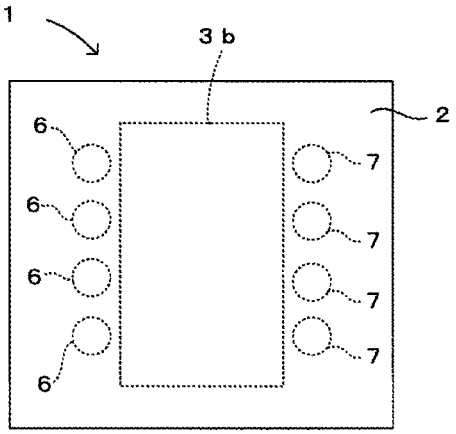
FIG. 23A
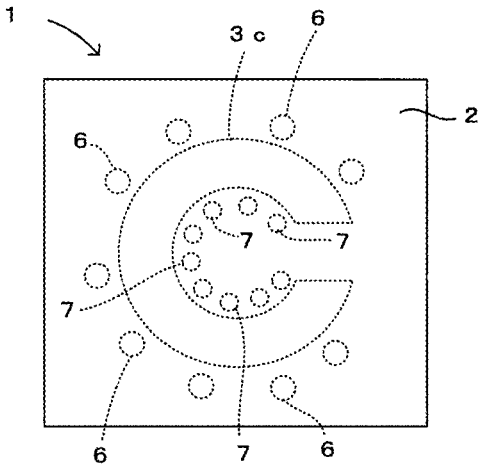
FIG. 23B

-- PRIOR ART --

COIL COMPONENT, COIL MODULE, AND METHOD FOR MANUFACTURING COIL COMPONENT

This is a continuation of International Application No. PCT/JP2015/055628 filed on Feb. 26, 2015 which claims priority from Japanese Patent Application No. 2014-041968 filed on Mar. 4, 2014. The contents of these applications are incorporated herein by reference in their entireties.

BACKGROUND

Technical Field

The present disclosure relates to a coil component including a coil that is formed of a coil core embedded in an insulating layer and a coil electrode helically wound around the coil core, a coil module including the coil component, and a method for manufacturing the coil component.

Conventionally, as shown in FIG. 24, a coil component 500 that includes a coil 501 provided in a core substrate 502 made of a printed circuit board or a prepreg is known (for example, refer to Patent Document 1). In the coil 501, a coil pattern 504 (coil electrode) is helically wound around a ring portion of a ring-shaped (endless) magnetic layer 503 formed in a core substrate 502. Note that, FIG. 24 shows a conventional coil component.

The coil pattern 504 includes a plurality of linear wiring electrode patterns 505 and 506 formed on the front and rear surfaces of the core substrate 502, respectively, so as to straddle the magnetic layer 503 in a plan view, and a plurality of interlayer connection conductors 507 formed in the core substrate 502. The wiring electrode patterns 505 and 506 on the front and rear surfaces are connected at their corresponding end portions through the interlayer connection conductors 507, so that the coil pattern 504 is formed so as to be helically wound around the magnetic layer 503. The endless magnetic layer 503 thereby forms a toroidal coil core and magnetic lines of force generated by the coil component 500 (coil 501) mainly pass through the endless magnetic layer 503. This forms a closed magnetic circuit structure having little leakage magnetic flux, thus allowing the obtainment of a high inductance value.

Patent Document 1: Japanese Unexamined Patent Application Publication No. 2000-40620 (refer to paragraph [0018], FIG.1, and the like)

BRIEF SUMMARY

Meanwhile, as shown in FIG. 24, the conventional interlayer connection conductor 507 described above is formed of, for example, a through-hole conductor formed by applying plating to the inside surface of a through-hole. Alternatively, the interlayer connection conductor 507 is formed of, for example, a via conductor formed by filling a through-hole with a conductive paste or applying via-fill plating to the inside of a through-hole. Thus, the following various problems may occur.

First, in order to form the through-hole conductor or the via conductor, it is required to apply plating to or charging the conductive paste into the inside of the through-hole having a small diameter formed in the core substrate 502. However, when the core substrate 502 is thick, it is difficult to apply plating to or charge the conductive paste into the inside of the entire through-hole having the small diameter across the core substrate 502 between the front surface and the rear surface, and therefore the tall (long) interlayer connection conductor 507 is hard to form. Thus, it is difficult to thicken the magnetic layer 503 forming the coil core.

Also, in order to improve the connectivity between the interlayer connection conductor 507 and each of the wiring electrode patterns 505 and 506 formed on the front and rear surfaces of the core substrate 502, both end portions of the interlayer connection conductor 507 are tried to be slightly protruded from the front and rear surfaces of the core substrate 502. However, in the conventional interlayer connection conductor 507 formed by the plating or the conductive paste, a conductive material spreads or exudes in the surface direction of the core substrate 502 from portions protruding from both openings of the through-hole in the front and rear surfaces of the core substrate 502, during applying the plating to or charging the conductive paste into the inside of the through-hole. Thus, the interlayer connection conductor 507 has a larger diameter at both end portions than the inner diameter of the through-hole, thus making it difficult to narrow the pitch of the interlayer connection conductors 507.

To form the conventional interlayer connection conductor 507, a through-hole is first formed in the core substrate 502 by laser beam machining or the like, and plating is applied to or a conductive paste is charged into the inside of the through-hole. Thus, a plurality of through-holes is required to be formed in the core substrate 502 with predetermined gaps in order to form the plurality of interlayer connection conductors 507. This makes it difficult to narrow the pitch of the interlayer connection conductors 507. Also, the formation of the through-holes by the laser beam machining is needed, resulting in an increase in cost for the coil component.

Considering the problems described above, the present disclosure aims at providing a coil component that includes a coil having a thick coil core and good inductance characteristics and is able to narrow the pitch of a coil electrode, a coil module including the coil component, and a method for manufacturing the coil component at low cost with ease.

The present disclosure provides a coil component including a coil that has a coil core embedded in an insulating layer; and a coil electrode provided in the insulating layer so as to be helically wound around the coil core. The coil electrode includes a plurality of first metal pins disposed across the direction of a winding axis of the coil electrode and arranged on one side of the coil core; a plurality of second metal pins disposed across the direction of the winding axis of the coil electrode and arranged on the other side of the coil core, such that the coil core is disposed between the arrangement of the first metal pins and the arrangement of the second metal pins; a plurality of first connection members each for connecting the first metal pin and the second metal pin paired with each other at one end portions of the first and second metal pins; and a plurality of second connection members each for connecting the first metal pin and the second metal pin that is adjoining on one side to the second metal pin paired with the first metal pin at other end portions of the first and second metal pins.

According to the disclosure structured as above, the coil electrode is helically wound around the coil core embedded in an insulating layer, to form the coil. Since the plurality of first metal pins are disposed across the direction of a central axis of the coil (the direction of magnetic flux generated inside the coil core), that is, the direction of the winding axis of the coil electrode and arranged on one side of the coil core, and the plurality of second metal pins are disposed across the direction of the central axis of the coil, that is, the direction of the winding axis of the coil electrode and arranged on the other side of the coil core, the plurality of first metal pins and the plurality of second metal pins are arranged across the coil core. The plurality of first connection members each connect the first metal pin and the second metal pin paired with each other at the one end portions of the first and second metal pins, and the plurality of second connection members each connect the first metal pin and the second metal pin that is adjoining on one side to the second metal pin paired with the first metal pin at the other end portions of the first and second metal pins, so that the coil electrode is formed so as to be helically wound around the coil core.

Therefore, since the wiring of the coil electrode is constituted of the plurality of first metal pins and the plurality of second metal pins (hereinafter also simply called "metal pins") in the direction (hereinafter also called "metal pin direction") across the direction of the winding axis of the coil electrode, and therefore it is possible to eliminate the need for applying plating to the inside of a through-hole or filling the through-hole with a conductive paste, in contrast to the conventional coil component. Thus, the wiring length of the coil electrode can be easily increased in the metal pin direction only by increasing the length of each metal pin. Therefore, it is possible to easily thicken the coil core in the metal pin direction.

Also, since the wiring of the coil electrode in the metal pin direction is formed of the metal pins, the wiring of the coil electrode can be formed in the metal pin direction only by arranging the metal pins, without necessarily forming a plurality of through-holes at predetermined gaps, in contrast to the conventional coil component. The width of the wiring of the coil electrode, which is formed of the metal pins, in the metal pin direction does not vary, in contrast to a conventional through-hole conductor or via conductor. Thus, it is possible to provide the coil component that includes the coil having the thick coil core and good inductance characteristics and is able to narrow the pitch of the coil electrode.

Also, the first metal pins and the second metal pins may be disposed so as to be protruded from one main surface of the insulating layer at the one end portions of the first and second metal pins, and so as to be protruded from the other main surface of the insulating layer at the other end portions of the first and second metal pins. The first connection members may be provided on the one main surface of the insulating layer. The second connection members may be provided on the other main surface of the insulating layer.

According to this structure, since each metal pin is protruded from the one main surface of the insulating layer at its one end portion, each metal pin can be connected to each first connection member not only at its one end surface but also at its peripheral surface in a connection portion between the first connection member and the one end portion of the metal pin on the one main surface. Thus, it is possible to improve the connection strength between the one end portion of each metal pin and the first connection member. Also, since each metal pin is protruded from the other main surface of the insulating layer at its other end portion, each metal pin can be connected to each second connection member not only at its other end surface but also at its peripheral surface in a connection portion between the second connection member and the metal pin on the other main surface. Thus, it is possible to improve the connection strength between the other end portion of each metal pin and the second connection member.

In contrast to the conventional through-hole conductor and via conductor, each metal pin protruded from the insulating layer becomes thicker at neither the one end portion nor the other end portion than at a portion embedded in the insulating layer. Thus, it is possible to narrow the pitch of the coil electrode in a state of protruding both the end portions of the metal pins from the insulating layer.

Also, the insulating layer may include a support layer through which the first metal pins and the second metal pins penetrate at the other end portions. The support layer may include fillet-shaped support portions each formed between a peripheral surface of the other end portion of each of the first and second metal pins and the support layer. The width of the coil core may be narrower than the distance between the arrangement of the first metal pins and the arrangement of the second metal pins, and a gap may be formed between each of the first and second metal pins and the coil core by contact of an edge of the coil core with an outer peripheral surface of the support portion.

Depending on the material of the coil core and the material of each metal pin, the gaps provided between each metal pin and the coil core may serve to improve the coil characteristics. Thus, by making the edges of the coil core, which is narrower than the distance between the arrangement of the first metal pins and the arrangement of the second metal pins, in contact with the outer peripheral surfaces of the support portions provided in the support layer, it is possible to position the coil core and certainly form the gaps between each of the metal pins and the coil core, thus serving to improve the coil characteristics.

Also, the first metal pins and the second metal pins may be arranged such that the distance between the arrangement of the first metal pins and the arrangement of the second metal pins is equal to the width of the coil core, so that each of the first and second metal pins may be in contact with the coil core.

Depending on the material of the coil core and the material of each metal pin, the contact between each metal pin and the coil core may improve the coil characteristics. Thus, the first metal pins and the second metal pins are arranged at the same distance as the width of the coil core, and each metal pin and the coil core are disposed so as to be in contact with each other, thus serving to improve the coil characteristics.

A gap may be formed between an outer peripheral surface of each of the first and/or second metal pins and the insulating layer.

According to this structure, the formation of the gaps reduces the effect of the permittivity of the insulating layer, and hence improves the coil characteristics.

The first metal pin and/or the second metal pin may be connected to the first and/or second connection members/member with joint members/a joint member, and the joint member may be covered with a plating film, and the plating film may be directly connected to the first metal pin and/or the second metal pin, and to the first connection member and/or the second connection member.

According to this embodiment, the joint member such as solder has a relatively high resistivity, but the joint member is covered with the plating film. Thus, it is possible to reduce a resistance at a connection portion between the metal pin and the connection member. Since a high frequency current flows through the surface plating film by a skin effect, this is especially effective at dealing with the high frequency current flowing. Also, when the metal pin and the connection member have a lower resistivity than the joint member such as solder, the joint member causes an increase in the resistance of the coil electrode. However, since the metal pin is directly connected to the connection member with the plating film, the resistance of the coil electrode is effectively reduced.

The coil may have the toroidal coil core, and the first metal pins may be arranged on one side, that is, at outer side portions of the coil core, while the second metal pins may be arranged on the other side, that is, at inner side portions of the coil core.

According to this structure, a closed magnetic circuit structure in which magnetic lines of force generated by the coil mainly pass through the ring-shaped toroidal coil core is formed, thus allowing providing the coil component having little leakage magnetic flux.

The second metal pin may have a smaller diameter than the first metal pin, and the first connection member and/or the second connection member may be formed in a tapered shape that becomes narrow with decreasing distance from the second metal pin.

According to this structure, by forming the first and/or second connection members/member into a tapered shape that becomes narrow with increasing distance from the first metal pin i.e. with decreasing distance from the second metal pin, it is possible to match the impedance between the first and second metal pins.

The first metal pins and the second metal pins may be each disposed so as to be exposed from the one main surface of the insulating layer at the one end portion, and so as to be exposed from the other main surface of the insulating layer at the other end portion. The first connection members may be provided on the one main surface of the insulating layer, while the second connection members may be provided on the other main surface of the insulating layer. The coil component may further include a resist layer that is laminated on the one main surface of the insulating layer so as to cover the first connection members. The resist layer may have a plurality of openings each of which is disposed in a position overlapping a connection position between one end surface of the first or second metal pin and the first connection member in a plan view, and is larger in size than the one end surface of the first or second metal pin disposed in a position overlapping the opening in a plan view.

According to this structure, the resist layer can prevent a short circuit between the first connection members. Heat tends to be generated in the connection position between the first or second metal pin and the first connection member when a large current flows therethrough, but providing the openings in the positions overlapping the connection positions in a plan view improves heat dissipation. Therefore, it is possible to provide the coil component that can deal with a large current flowing, while preventing a short circuit between the first connection members.

The opening disposed in a position overlapping the one end surface of the second metal pin in a plan view is larger in size than the opening disposed in a position overlapping the one end surface of the first metal pin in a plan view.

According to this structure, when, for example, the second metal pin has a higher calorific value than a first metal pin, increasing the size of the openings serves to improve heat dissipation in the vicinity of the connection position between the second metal pin and the first connection member.

The opening may be formed so as to overlap the entire first connection member in a plan view.

According to this structure, the openings disposed so as to overlap the entire first connection member allow further improvement in the heat dissipation of the coil component.

A plurality of the resist layers among which the plurality of openings is formed in the same positions in a plan view may be laminated on the one main surface of the insulating layer. The opening formed in the outer resist layer is larger in size than the opening formed in the inner resist layer.

According to this structure, since the openings are formed so as to increase their size from the inner layer side to the outer layer side, it is possible to dissipate heat generated in the coil component with high efficiency.

The opening may be disposed corresponding to the plurality of alternate second metal pins.

According to this structure, even if, for example, the arrangement distance between the second metal pins is narrower than the arrangement distance between the first metal pins, it is possible to increase the size of the openings.

A coil module according to the present disclosure includes the coil component according to any one of claims 9 to 13 and a module substrate on which the coil component is mounted. Dummy electrodes are formed on a mounting surface of the module substrate that is opposite to the resist layer of the coil component, in positions corresponding to each of the openings. The dummy electrode and the first connection member disposed in the corresponding opening are connected with a joint member.

According to this structure, since heat generated in the coil component can be dissipated with high efficiency to the side of the module substrate through the joint member, it is possible to provide the coil module having improved heat dissipation.

A method for manufacturing a coil component according to the present disclosure is a method for manufacturing a coil component including a coil having a coil core embedded in an insulating layer and a coil electrode provided in the insulating layer so as to be helically wound around the coil core. The method includes a preparation step for preparing a terminal assembly by preparing a transfer body to support one end portions of a plurality of first metal pins and a plurality of second metal pins constituting the coil electrode on one surface of the transfer body, setting a predetermined area having the same shape in a plan view as the coil core in the one surface of the transfer body, arranging the first metal pins on one side of the predetermined area along the direction of a winding axis of the coil electrode, and arranging the second metal pins on the other side of the predetermined area along the direction of the winding axis of the coil electrode, such that the first metal pins and the second metal pins are opposite across the predetermined area; a transfer step for erecting the terminal assembly on an adhesive support layer that is formed of a thermosetting resin on a release sheet, from the side of other end portions of the first and second metal pins; a disposition step for removing the transfer body and disposing the coil core between the arrangement of the first metal pins and the arrangement of the second metal pins; a sealing step for sealing the coil core, the first metal pins, and the second metal pins using a resin to form the insulating layer including the support layer; and a removal step for, after the release sheet is peeled off, removing the resin from both of one and the other main surfaces of the insulating layer by polishing or grinding, so as to expose both of the one and other end portions of each of the first and second metal pins.

According to the disclosure configured as described above, the transfer body is prepared to support the one end portions of the plurality of first metal pins and the plurality of second metal pins constituting the coil electrode on one surface of the transfer body. The predetermined area having the same shape in a plan view as the coil core is set in the one surface of the transfer body. The first metal pins are arranged on one side of the predetermined area along the direction of a winding axis of the coil electrode. The second metal pins are arranged on the other side of the predetermined area along the direction of the winding axis of the coil electrode, so that the terminal assembly in which the first metal pins and the second metal pins are opposite across the predetermined area is prepared. Next, after the terminal assembly is erected on the adhesive support layer that is formed of the thermosetting resin on the release sheet, from the side of the other end portions of the first and second metal pins, the transfer body is removed and the coil core is disposed between the arrangement of the first metal pins and the arrangement of the second metal pins. Subsequently, the coil core and the metal pins are sealed using the resin to form the insulating layer including the support layer. Then, after the release sheet is peeled off, the resin is removed from both of the one and other main surfaces of the insulating layer by polishing or grinding, so as to expose both of the one and other end portions of each metal pin.

Therefore, in contrast to a conventional art, the metal pins and the coil core can be easily disposed in the insulating layer of the coil component at the same time, without necessarily providing any through-holes for forming through-hole conductors or via conductors in a core substrate such as a printed circuit board or a prepreg, nor without necessarily performing any particular processing for forming disposition space for the coil core e.g. forming an opening for the disposition of the coil core. Thus, it is possible to significantly simplify the manufacturing process. Also, the dispositional relationship of the coil provided in the coil component, such as the distance between each metal pin and the coil core, is easily adjustable only by regulating an arrangement state of each metal pin in the terminal assembly. When adjusting the positional relationship between each metal pin and the coil core, there is no requirement for design change in a core substrate, a mold for resin sealing, and the like, and therefore it is possible to prevent an increase in manufacturing cost for the coil component accompanying with the design change. Also, eliminating the need for providing the core substrate allows manufacturing the coil component at very low cost. Also, eliminating the need for providing the core substrate allows reducing the height of the coil component.

The method for manufacturing the coil component may further include a thermosetting step for, after the transfer step, thermosetting the support layer while making the resin of the support layer rise on a peripheral surface of the other end portion of each of the first and second metal pins, in order to form a fillet-shaped support portion between the peripheral surface of the other end portion of each of the first and second metal pins and the support layer.

According to this structure, since the support layer is thermoset and the fillet-shaped support portion is formed between the peripheral surface of the other end portion of each metal pin and the support layer, it is possible to improve the support strength of each metal pin owing to the support layer.

In the disposition step, an edge of the coil core that is narrower than the distance between the arrangement of the first metal pins and the arrangement of the second metal pins may be in contact with an outer peripheral surface of the support portion, in order to form a gap between each of the first and second metal pins and the coil core.

Depending on the material of the coil core and the material of each metal pin, the gaps provided between each metal pin and the coil core may serve to improve the coil characteristics. Thus, by making the edges of the coil core in contact with the outer peripheral surfaces of the support portions provided in the support layer and positioning the coil core, it is possible to certainly form the gaps between each of the metal pins and the coil core and manufacture the coil component having improved coil characteristics.

In the disposition step, the coil core that has the same width as the distance between the arrangement of the first metal pins and the arrangement of the second metal pins may be disposed so that the coil core may be in contact with the first and second metal pins.

Depending on the material of the coil core and the material of each metal pin, the contact between each metal pin and the coil core may improve the coil characteristics. Thus, the disposition of the coil core the width of which is the same as the distance between the arrangement of the first metal pins and the second metal pins allows a certain contact between each metal pin and the coil core and the manufacture of the coil component having improved coil characteristics.

The method for manufacturing the coil component may further include a connection step in which after the resin of the insulating layer is removed such that the one end portions of the first and second metal pins are protruded and exposed from the one main surface of the insulating layer, and the other end portions of the first and second metal pins are protruded and exposed from the other main surface of the insulating layer in the removal step, first connection members each connect the one end portions of the first metal pin and the second metal pin paired with each other on the one main surface of the insulating layer, and second connection members each connect the other end portions of the first metal pin and the second metal pin that is adjoining on one side to the second metal pin paired with the first metal pin on the other main surface of the insulating layer.

According to this structure, since each metal pin is protruded from the one main surface of the insulating layer at its one end portion, each metal pin can be connected to each first connection member not only at its one end surface but also at its peripheral surface in a connection portion between the first connection member and the one end portion of the metal pin on the one main surface. Thus, it is possible to improve the connection strength between the one end portion of each metal pin and the first connection member. Also, since each metal pin is protruded from the other main surface of the insulating layer at its other end portion, each metal pin can be connected to each second connection member not only at its other end surface but also at its peripheral surface in a connection portion between the second connection member and the metal pin on the other main surface. Thus, it is possible to improve the connection strength between the other end portion of each metal pin and the second connection member.

The coil may have the toroidal coil core, and the first metal pins may be arranged on one side, that is, at outer side portions of the coil core, while the second metal pins may be arranged on the other side, that is, at inner side portions of the coil core.

According to this structure, a closed magnetic circuit structure in which magnetic lines of force generated by the coil mainly pass through the ring-shaped toroidal coil core is formed, thus allowing providing the coil component having little leakage magnetic flux.

According to the present disclosure, the wiring of the coil electrode in the direction across the direction of the winding axis of the coil electrode is constituted of the plurality of first metal pins and the plurality of second metal pins. The wiring length of the coil electrode is easily increased in the metal pin direction only by increasing the length of each metal pin. Thus, the thickness of the coil core is easily increased in the metal pin direction. The wiring of the coil electrode can be formed in the metal pin direction only by arranging the metal pins. Thus, it is possible to provide the coil component that includes the coil having the thick coil core and good inductance characteristics and is able to narrow the pitch of the coil electrode.

BRIEF DESCRIPTION OF THE SEVERAL VIEWS OF THE DRAWINGS

FIGS. 3A and 3B include drawings that show an example of a method for manufacturing the coil component of FIG. 1, and FIG. 3A is a plan view and FIG. 3B is a front view.

FIGS. 4A and 4B include drawings that show the next step to the step of FIGS. 3A and 3B in the example of the method for manufacturing the coil component of FIG. 1, and FIG. 4A is a plan view and FIG. 4B is a front view.

FIGS. 5A and 5B include drawings that show the next step to the step of FIG. 4 in the example of the method for manufacturing the coil component of FIG. 1, and FIG. 5A is a plan view and FIG. 5B is a front view.

FIGS. 6A and 6B includes drawings that show the next step to the step of FIGS. 5A and 5B in the example of the method for manufacturing the coil component of FIG. 1, and FIG. 6A is a plan view and FIG. 6B is a front view.

FIGS. 7A and 7B include drawings that show the next step to the step of FIGS. 6A and 6B in the example of the method for manufacturing the coil component of FIG. 1, and FIG. 7A is a plan view and FIG. 7B is a front view.

FIGS. 8A and 8B include drawings that show the next step to the step of FIGS. 7A and 7B in the example of the method for manufacturing the coil component of FIG. 1, and FIG. 8A is a plan view and FIG. 8B is a front view.

FIGS. 9A and 9B include drawings that show the next step to the step of FIGS. 8A and 8B in the example of the method for manufacturing the coil component of FIG. 1, and FIG. 9A is a plan view and FIG. 9B is a front view.

FIG. 10 is a plan view that shows the next step to the step of FIGS. 9A and 9B in the example of the method for manufacturing the coil component of FIG. 1.

FIG. 11 is a plan view that shows the next step to the step of FIG. 10 in the example of the method for manufacturing the coil component of FIG. 1.

FIG. 22 is a sectional view of a coil module according to the fifth embodiment of the present disclosure.

FIGS. 23A and 23B include drawings of modification examples of a coil core, and FIG. 23A is a drawing of a linear coil core, and FIG. 23B is a drawing of an approximately C-shaped coil core.

DETAILED DESCRIPTION

<First Embodiment>

A coil component according to a first embodiment of the present disclosure will be described.

(Schematic Structure of Coil Component)

Figure 1:
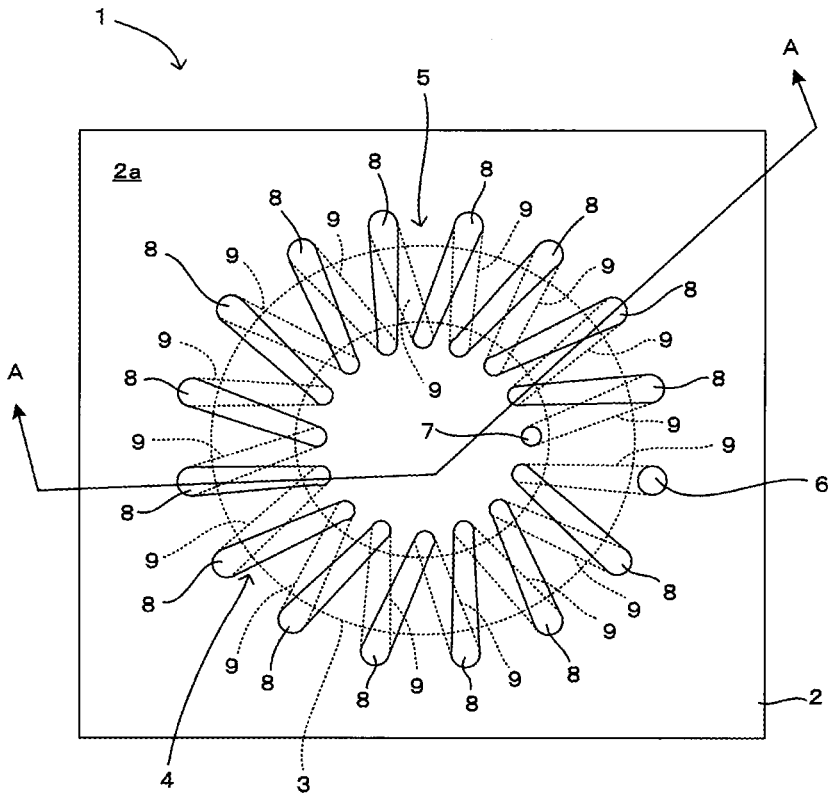
FIG. 1 is a plan view of a coil component according to a first embodiment of the present disclosure.

The schematic structure of a coil component 1 will be described with reference to FIGS. 1 and 2. FIG. 1 is a plan view of the coil component according to the first embodiment of the present disclosure, and FIG. 2 is a sectional view of the coil component of FIG. 1 taken along a line A-A.

Figure 2:
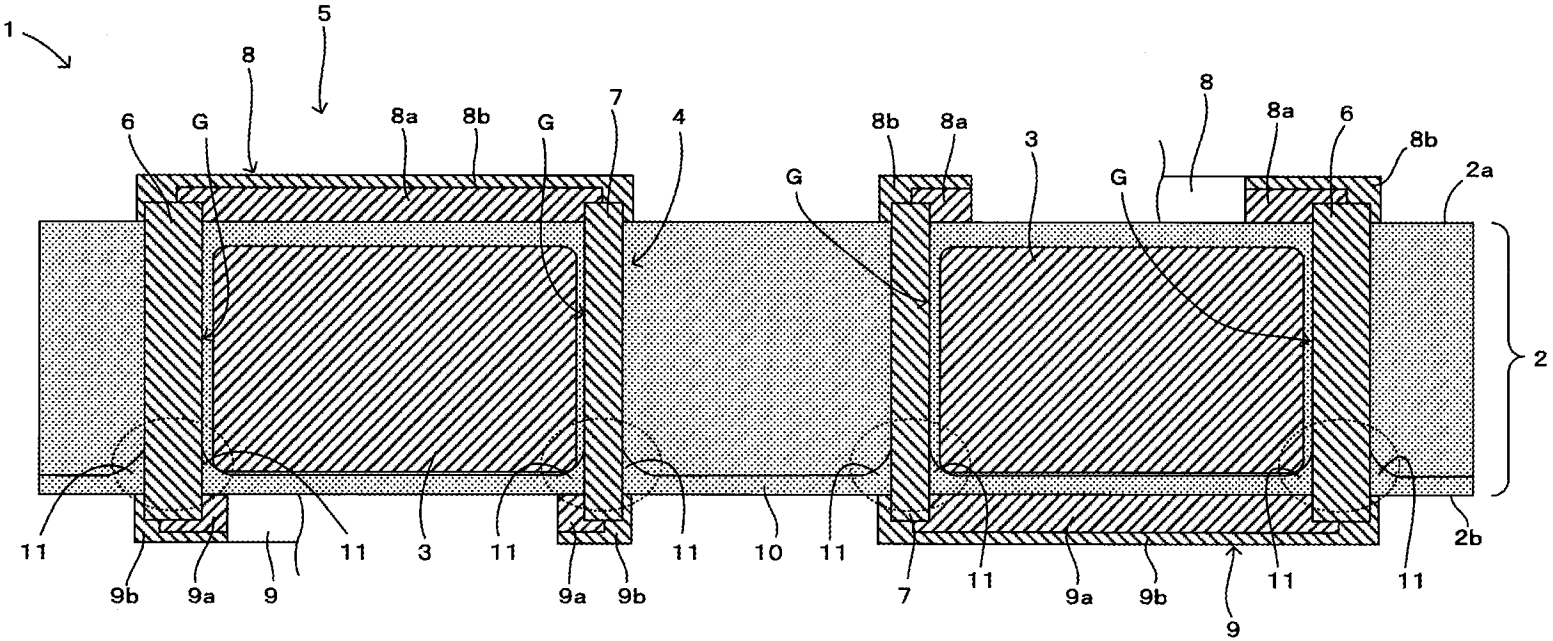
FIG. 2 is a sectional view of the coil component of FIG. 1 taken along a line A-A.

As shown in FIGS. 1 and 2, the coil component 1 includes a coil 5 that has a coil core 3 embedded in a resin insulating layer 2 and a coil electrode 4 provided in the resin insulating layer 2 so as to be helically wound around the coil core 3. Note that, the coil 5 has the circular ring-shaped toroidal coil core 3 in this embodiment, but the shape of a toroidal coil core is not specifically limited as long as it is in a ring shape such as a rectangular ring shape.

The resin insulating layer 2 (corresponding to "insulating layer" of the present disclosure) is made of a common resin for resin sealing (mold) such as a thermosetting epoxy resin. The coil core 3 is made of a magnetic material such as ferrite or iron, which is generally adopted as a material for a coil core.

The coil electrode 4 includes a plurality of metal pins 6, a plurality of metal pins 7, a plurality of linear one-side wiring electrode patterns 8 (corresponding to "first connection members" of the present disclosure) provided on one main surface 2*a* of the resin insulating layer 2, and linear other-side wiring electrode patterns 9 (corresponding to "second connection members" of the present disclosure) provided on the other main surface 2*b* of the resin insulating layer 2.

The first metal pins 6 are each disposed in an approximately orthogonal manner to the direction of a central axis of the coil 5, that is, the direction of a winding axis of the coil electrode 4, and are arranged along the outer periphery of the coil core 3 on one side, that is, the outer side of the coil core 3. The second metal pins 7 are each disposed in an approximately orthogonal manner to the direction of the central axis of the coil 5, that is, the direction of the winding axis of the coil electrode 4, and are arranged along the inner periphery of the coil core 3 on the other side, that is, the inner side of the coil core 3, such that the coil core 3 is disposed between the first metal pin 6 and the second metal pin 7. Note that, the direction of the winding axis of the coil electrode in the present disclosure coincides with the direction of magnetic flux (a magnetic field) generated inside the ring-shaped coil core 3. The ring-shaped coil core 3 is used in the first embodiment, and the magnetic flux is generated so as to rotate in a circumferential direction thereof. The metal pins 6 and 7 are each protruded and exposed from the one main surface 2*a* of the resin insulating layer 2 at their one end portions, while are each protruded and exposed from the other main surface 2*b* of the resin insulating layer 2 at their other end portions. The metal pins 6 and 7 are each made of a metal material that is generally adopted as a material for a wiring electrode, such as Cu, Au, Ag, Al, Fe, a Cu alloy such as a Cu—Ni alloy or a Cu—Fe alloy, or the like. Each of the metal pins 6 and 7 may be formed of a pin-shaped member of Ni-plated Cu. The first metal pins 6 and/or the second metal pins 7 may be each disposed in the direction of the central axis (magnetic flux) of the coil 5, that is, orthogonal to the direction of the winding axis of the coil electrode 4, for example, the first metal pins 6 and/or the second metal pins 7 may be each disposed in an inclined manner with respect to a direction orthogonal to the direction of the winding axis of the coil electrode 4.

Note that, the first and second metal pins 6 and 7 are formed by, for example, shearing metal conductive wires having desired diameters and circular or polygonal cross sections at a predetermined length. That is to say, the first and second metal pins 6 and 7 included in the coil component 1 are formed of metal wires that already have a predetermined shape and strength. In other words, the first and second metal pins 6 and 7 are different members from such as a hardened material of a conductive paste, a plated growth material in which a metallic material has grown by plating into a predetermined shape, and linear metal members such as a sintered body of metal particles generated during manufacturing the coil component 1. As described above, the first and second metal pins 6 and 7 are substituted for through-hole conductors or via conductors disposed in an orthogonal manner to the top and bottom surfaces of the resin insulating layer 2.

Also, the first metal pins 6 and the second metal pins 7 are connected in pairs at their one end portions through the one-side wiring electrode patterns 8. Each first metal pin 6 is connected to the second metal pin 7 that is adjoining to the second metal pin 7 paired with the first metal pin 6 on one side (a clockwise direction in FIG. 1) at their other end portions through the other-side wiring electrode pattern 9. By connecting the metal pins 6 and 7 like this, the coil electrode 4 that is helically wound around the coil core 3 is formed in the resin insulating layer 2.

Note that, in this embodiment, each of the second metal pins 7 arranged at inner side portions of the coil core 3 has a smaller diameter than each of the first metal pins 6 arranged at outer side portions of the coil core 3. When the winding number of the coil 5 is increased to increase an inductance, space for disposing the metal pins 7 is limited inside the ring-shaped coil core 3. Thus, reducing the diameter of each metal pin 7 and the cross-sectional area thereof facilitates increasing the winding number of the coil 5. The reduced diameter may cause an increase in the resistance value of each metal pin 7 and degradation in coil characteristics. However, since each of the metal pins 6 arranged at the outer side portions of the coil core 3 having sufficient space for disposition has a larger diameter than the metal pin 7, it is possible to reduce the resistance of each metal pin 6 and therefore prevent an increase in the resistance value of the entire coil electrode 4.

Also, as shown in FIG. 2, in this embodiment, each one-side wiring electrode pattern 8 includes a base electrode layer 8*a* formed on the one main surface 2*a* of the resin insulating layer 2, and a plated electrode layer 8*b* laminated on the base electrode layer 8*a*. Each other-side wiring electrode pattern 9 includes a base electrode layer 9*a* formed on the other main surface 2*b* of the resin insulating layer 2, and a plated electrode layer 9*b* laminated on the base electrode layer 9*a*.

In this embodiment, each base electrode layer 8*a* is formed linearly on the one main surface 2*a* of the resin insulating layer 2 by screen printing using a conductive paste containing a filler metal (for example, a Cu filler metal) in an organic solvent, so as to connect a pair of the first metal pin 6 and the second metal pin 7 at their one end portions. Also, the base electrode layer 8*a* covers part of each of one end surfaces of the metal pins 6 and 7 at both end portions.

Each plated electrode layer 8*b* is formed by plating, so as to cover the base electrode layer 8*a* and part of the one end portion of each of the metal pins 6 and 7 protruded and exposed from the one main surface 2*a* of the resin insulating layer 2 that is not covered with the base electrode layer 8*a*. Thus, the one end portion of each of the metal pins 6 and 7 connected to the one-side wiring electrode pattern 8 has an area that is directly connected to the plated electrode layer 8*b*.

Each base electrode layer 9*a* is formed linearly on the other main surface 2*b* of the resin insulating layer 2 by screen printing using a conductive paste having the same components as above, so as to connect the first metal pin 6 and the second metal pin 7 that is adjoining on one side to the second metal pin 7 paired with the first metal pin 6 at their other end portions. The base electrode layer 9*a* covers part of each of the other end surfaces of the metal pins 6 and 7 at both end portions.

Each plated electrode layer 9*b* is formed by plating, so as to cover the base electrode layer 9*a* and part of the other end portion of each of the metal pins 6 and 7 protruded and exposed from the other main surface 2*b* of the resin insulating layer 2 that is not covered with the base electrode layer 9*a*. Thus, the other end portion of each of the metal pins 6 and 7 connected to the other-side wiring electrode pattern 9 has an area that is directly connected to the plated electrode layer 9*b*.

Note that, in this embodiment, the plated electrode layers 8*b* and 9*b* are formed by, for example, Cu plating using the metal of the metal pins 6 and 7 and the filler metal contained in the base electrode layers 8*a* and 9*a* as plate cores. The linear base electrode layer 8*a* may have a narrower line width at both end portions than the width of the one end surface of each metal pin 6 or 7. The linear base electrode layer 9*a* may have a narrower line width at both end portions than the width of the other end surface of each metal pin 6 or 7. According to this structure, the base electrode layer 8*a* can easily cover part of each of the one end surfaces of the metal pins 6 and 7 at both the end portions formed narrowly. The base electrode layer 9*a* can easily cover part of each of the other end surfaces of the metal pins 6 and 7 at both the end portions formed narrowly.

Note that, the shape of each of both the end portions of the base electrode layers 8*a* and 9*a* is arbitrarily changeable, as long as the base electrode layer 8*a* can cover part of each of the one end surfaces of the metal pins 6 and 7 at both the end portions, and the base electrode layer 9*a* can cover part of each of the other end surfaces of the metal pins 6 and 7 at both the end portions. The plated electrode layers 8*b* and 9*b* may be made of the same metal material as the metal pins 6 and 7, or a different metal material therefrom. The plated electrode layers 8*b* and 9*b* can be made of the same metal material in order to prevent variations in a resistance value in the coil electrode 4.

Also, as shown in FIG. 1, in this embodiment, the one-side wiring electrode pattern 8 and the other-side wiring electrode pattern 9 are formed so as to match the impedance between the first metal pin 6 and the second metal pin 7, which has a different diameter from the first metal pin 6. That is to say, both of the wiring electrode patterns 8 and 9 are formed into a tapered shape that becomes narrow with increasing distance from the first metal pin 6 i.e. with decreasing distance to the second metal pin 7, in order to match the impedance between the metal pins 6 and 7. Also, as shown in the same drawing, of the metal pins 6 and 7, the metal pins 6 and 7 to which the one-side wiring electrode pattern 8 is not connected are formed with a plated electrode layer at their one end portions, just as with the plated electrode layers 8*b* and 9*b*, so as to be used as terminals for signal extension.

Also, as shown in FIG. 2, in this embodiment, the resin insulating layer 2 includes a support layer 10 through which the other end portions of the metal pins 6 and 7 penetrate. Also, as shown in areas enclosed by dotted lines in the drawing, fillet-shaped support portions 11, which are formed integrally with the support layer 10 by a resin of the support layer 10 rising on the peripheral surfaces of the other end portions of the metal pins 6 and 7, are each provided between the other end portion of each metal pin 6 or 7 and the support layer 10. Since the edges of the coil core 3 are in contact with outer peripheral surfaces of the support portions 11, gaps G are formed between each metal pin 6 or 7 and the coil core 3. Note that, a fillet-shaped support portion that is formed separately from the support layer 10 may be formed between the other end portion of each metal pin 6 or 7 and the support layer 10. When the support portion is formed separately from the support layer 10, the support portion may be made of a material other than resin.

Note that, the edges of the coil core 3 is rounded in an example of FIG. 2, but the edges of the coil core 3 is not necessarily required to be rounded. In this embodiment, the doughnut-shaped coil core 3 in a plan view is formed such that the width of a helically wound portion of the coil electrode 4 becomes narrower than the distance between each of the arranged first metal pins 6 and each of the arranged second metal pins 7.

(Method for Manufacturing Coil Component)

An example of a method for manufacturing the coil component 1 will be described with reference to FIGS. 3 to 11. FIGS. 3 to 11 are drawings that show an example of the method for manufacturing the coil component shown in FIG. 1, and each show a different step. Note that, in FIGS. 3 to 9, (a) is a plan view, while (b) is a front view. FIGS. 10 and 11 are plan views. In the front views of (b) of FIGS. 4 to 9, cross sections of part of the coil component are illustrated.

First, as shown in FIG. 3A and FIG. 3B, a plate-like transfer body 20 is prepared to support a plurality of first metal pins 6 and a plurality of second metal pins 7 forming the coil electrodes 4 at their one end portions on one surface 20*a* thereof. On the one surface 20*a* of the transfer body 20, a doughnut-shaped predetermined area R having approximately the same shape as a ring-shaped toroidal coil core 3 in a plan view is set. Then, the first metal pins 6 are arranged on one side i.e. at outer side portions of the predetermined area R along a winding axis direction of a coil electrode 4 (an outer peripheral direction of the predetermined area R). The second metal pins 7 are arranged on the other side i.e. at inner side portions of the predetermined area R along the winding axis direction of the coil electrode 4 (an inner peripheral direction of the predetermined area R). Thus, a terminal assembly 100 in which the first metal pins 6 and the second metal pins 7 are disposed opposite each other across the predetermined area R (a preparation step).

Subsequently, as shown in FIG. 4A and FIG. 4B, an adhesive support layer 10 is formed with a thickness of approximately 50 to approximately 100 μm by a thermosetting resin (for example, a liquid resin) on the release sheet 21. Then, as shown in FIG. 5A and FIG. 5B, the metal pins 6 and 7 are penetrated at their other end portions into the support layer 10, to erect the terminal assembly 100 (a transfer step). Next, the support layer 10 is thermoset, and the resin of the support layer 10 is made rise on the peripheral surface of the other end portion of each metal pin 6 or 7 so as to form a fillet-shaped support portion 11 between the peripheral surface of the other end portion of each metal pin 6 or 7 and the support layer 10 (a thermosetting step: refer to FIG. 2). Therefore, since the support layer 10 is thermoset and the fillet-shaped support portion 11 is formed between the peripheral surface of the other end portion of each metal pin 6 or 7 and the support layer 10 in the thermosetting process, it is possible to improve the support strength of each metal pin 6 or 7 owing to the support layer 10.

Note that, any release sheet may be used as the release sheet 21 such as a sheet in which a release layer is formed on a resin sheet of polyethylene terephthalate, polyethylene naphthalate, polyimide, or the like, or a resin sheet of a fluorine resin or the like having releasing properties by itself. The shape of the fillet-shaped support layer 10 is adjustable by changing the type or amount of resin for forming the support layer 10 or adjusting the wettability of each metal pin 6 or 7 by a surface treatment.

Then, the transfer body 20 is removed as shown in FIG. 6A and FIG. 6B, and a coil core 3 is disposed between each first metal pin 6 and each second metal pin 7 (a disposition step) as shown in FIG. 7A and FIG. 7B. In this embodiment, as shown in FIG. 2, since the coil core 3 is positioned between the metal pins 6 and 7 such that the edges of the doughnut-shaped coil core 3 in a plan view, which is narrower at a portion around which the coil electrode 4 is helically wound than the arrangement distance between each of the arranged first metal pins 6 and each of the arranged second metal pins 7, are in contact with the outer peripheral surfaces of the support portions 11, gaps G are formed between each of the metal pins 6 and 7 and the coil core 3.

Next, as shown in FIG. 8A and FIG. 8B, the coil core 3 and the metal pins 6 and 7 are resin-sealed using the same resin as that of the support layer 10 to form a resin insulating layer 2 including the support layer 10 (a sealing step). Note that, a different resin from that of the support layer 10 may be used for the resin sealing. Also, a liquid resin may be used for the support layer 10, while a solid resin may be used for the resin sealing. Subsequently, as shown in FIG. 9A and FIG. 9B, after the release sheet 21 is peeled off, the resin is removed from both main surfaces 2*a* and 2*b* of the resin insulating layer 2 by polishing or grinding so as to expose both end portions of each metal pin 6 or 7 (a removal step).

In this embodiment, the resin is removed from both the main surfaces 2*a* and 2*b* of the resin insulating layer 2 such that the one end portion of each metal pin 6 or 7 is protruded and exposed from the one main surface 2*a* of the resin insulating layer 2, while the other end portion of each metal pin 6 or 7 is protruded and exposed from the other main surface 2*b* of the resin insulating layer 2. Note that, for example, by polishing both the one and other main surfaces 2*a* and 2*b* of the resin insulating layer 2 using an abrasive that is softer than the metal pins 6 and 7 and harder than the resin insulating layer 2, both of the one and other end portions of each metal pin 6 or 7 can be protruded and exposed from the resin insulating layer 2.

Next, as shown in FIGS. 1 and 2, the one-side wiring electrode pattern 8 connects the one end portions of the first metal pin 6 and the second metal pin 7 that are paired with each other on the one main surface 2*a* of the resin insulating layer 2. Also, the other-side wiring electrode pattern 9 connects the other end portions of the first metal pin 6 and the second metal pin 7 that is adjoining on one side to the second metal pin 7 paired with the first metal pin 6 on the other main surface 2*b* of the resin insulating layer 2, so that the coil component 1 is completed (a connection step).

Note that, in this embodiment, the connection step is performed as follows.

First, as shown in FIG. 10, a base electrode layer 8*a* is formed on the one main surface 2*a* of the resin insulating layer 2 to connect the one end portions of the first metal pin 6 and the second metal pin 7 that are paired with each other, and a base electrode layer 9*a* is formed on the other main surface 2*b* of the resin insulating layer 2 to connect the other end portions of the first metal pin 6 and the second metal pin 7 that is adjoining on one side to the second metal pin 7 paired with the first metal pin 6 by screen printing using a conductive paste. Subsequently, as shown in FIG. 11, plated electrode layers 8*b* and 9*b* are formed on the base electrode layers 8*a* and 9*a*, respectively, by plating, and therefore the one-side wiring electrode patterns 8 and the other-side wiring electrode patterns 9 are formed and the connection step is completed.

(Method for Manufacturing Terminal Assembly)

An example of a method for manufacturing the terminal assembly 100 as shown in FIGS. 3A and 3B will be described.

First, first and second metal pins 6 and 7 formed into the shape of a circular cylinder or a polygonal column are prepared by, for example, shearing metal conductive wires having desired diameters and circular or polygonal cross sections at a predetermined length. Also, for example, a transfer body 20, which is formed of a plate-shaped member made of a resin material such as a glass epoxy resin and a support layer made of a bonding layer or an adhesive layer provided on one surface of the plate-shaped member, is prepared. By erecting (mounting) each metal pin 6 or 7 on the transfer body 20, a terminal assembly 100 into which the metal pins 6 and 7 and the transfer body 20 are integrally formed is completed. Note that, the metal pins 6 and 7 are supported integrally with the transfer body 20 by bonding or adhesion of their one end portions to the support layer.

Note that, the support layer of the transfer body 20 may be formed by applying a liquid adhesive or tackifier to the one surface of the plate-shaped member, or by sticking an adhesive or tackifier sheet to the one surface of the plate-shaped member. To form the support layer, an epoxy or acrylic adhesive or tackifier can be used, but, for example, the support layer may be formed with a tackifier that has the properties of softening by being heated to a predetermined temperature or more and hardening by being cooled. By forming the support layer using the tackifier having such properties, it is possible to prevent adhesion of dirt and dust to the support layer of the transfer body 20 of the terminal assembly 100 in storage, because the support layer of the transfer body 20 is in a hardened state when the terminal assembly 100 is in storage.

The disposition of the metal pins 6 and 7 on the one surface of the transfer body 20 may be determined such that the metal pins 6 and 7 are disposed in necessary positions of the support layer 10 in accordance with design of the coil component 1, when the terminal assembly 100 is erected on the support layer 10 of the release sheet 21.

As described above, according to the above embodiment, the wiring of the coil electrode 4 is constituted of the metal pins 6 and 7 in a metal pin direction (perpendicular direction to the paper of FIG. 2), and therefore it is possible to eliminate the need for applying plating to the inside surface of a through-hole or filling the through-hole with a conductive paste, in contrast to the conventional coil component. Thus, the wiring length of the coil electrode 4 can be easily increased in the metal pin direction only by increasing the length of each metal pin 6 or 7. Therefore, it is possible to easily thicken the coil core 3 in the metal pin direction.

Also, the wiring of the coil electrode 4 can be formed in the metal pin direction only by arranging the metal pins 6 and 7, without necessarily forming a plurality of through-holes at predetermined gaps, in contrast to the conventional coil component. The width of the wiring of the coil electrode 4, which is formed of the metal pins 6 and 7, in the metal pin direction does not vary, in contrast to a conventional through-hole conductor or via conductor. Thus, it is possible to provide the coil component 1 that includes the coil 5 having the thick coil core 3 and good inductance characteristics and is able to narrow the pitch of the coil electrode 4. Also, since narrowing the pitch of the coil electrode 4 brings about an increase in the winding number of the coil 5, it is possible to provide the coil component 1 including the coil 5 having good coil characteristics.

Also, since each metal pin 6 or 7 is protruded from the one main surface 2*a* of the resin insulating layer 2 at its one end portion, each metal pin 6 or 7 can be connected to each one-side wiring electrode pattern 8 not only at its one end surface but also at its peripheral surface in a connection portion between the one-side wiring electrode pattern 8 and the metal pin 6 or 7 on the one main surface 2*a*. Thus, it is possible to improve the connection strength between the one end portion of each metal pin 6 or 7 and the one-side wiring electrode pattern 8. Also, since each metal pin 6 or 7 is protruded from the other main surface 2*b* of the resin insulating layer 2 at its other end portion, each metal pin 6 or 7 can be connected to each other-side wiring electrode pattern 9 not only at its other end surface but also at its peripheral surface in a connection portion between the other-side wiring electrode pattern 9 and the metal pin 6 or 7 on the other main surface 2*b*. Thus, it is possible to improve the connection strength between the other end portion of each metal pin 6 or 7 and the other-side wiring electrode pattern 9. An increase in a contact area between each of metal pins 6 and 7 and the one-side wiring electrode pattern 8 and the other-side wiring electrode pattern 9 allows forming the coil electrode having a lower resistance.

In contrast to the conventional through-hole conductor and via conductor, each metal pin 6 or 7 protruded from the resin insulating layer 2 becomes thicker at neither the one end portion nor the other end portion than at a portion embedded in the resin insulating layer 2. Thus, since the metal pins 6 and 7 protruded from the resin insulating layer 2 are kept being no contact with each other at their both end portions, it is possible to narrow the pitch of the coil electrode 4 in a state of protruding both the end portions of the metal pins 6 and 7 from both the main surfaces 2*a* and 2*b* of the resin insulating layer 2.

Depending on the material of the coil core 3 and the material of each metal pin 6 or 7, the gaps G provided between each metal pin 6 or 7 and the coil core 3 may serve to improve the coil characteristics. Thus, by contacting the edges of the outer peripheral surface of the coil core 3, which is narrower at the portion around which the coil electrode 4 is helically wound than the distance between the arrangement of the arranged first metal pins 6 and the arrangement of the second metal pins 7, with the outer peripheral surfaces of the support portions 11 provided in the support layer 10, it is possible to position the coil core 3 and certainly form the gaps G between each of the metal pins 6 and 7 and the coil core 3, thus serving to improve the coil characteristics. Note that, the gaps G are easily provided by contacting the edges of the outer peripheral surface of the coil core 3 with the outer peripheral surfaces of the support portions 11 provided in the support layer 10 in the above embodiment, but gaps may be provided in another method.

The coil 5 has the toroidal coil core 3, and the first metal pins 6 are arranged on one side i.e. at outer side portions of the coil core 3 along the outer peripheral surface, while the second metal pins 7 are arranged on the other side i.e. at inner side portions of the coil core 3 along the inner peripheral surface. This forms a closed magnetic circuit structure in which magnetic lines of force generated by the coil 5 mainly pass through the ring-shaped toroidal coil core 3, thus allowing providing the coil component 1 having little leakage magnetic flux.

Also, according to the above-described method for manufacturing the coil component 1, the metal pins 6 and 7 and the coil core 3 can be easily disposed in the resin insulating layer 2 of the coil component 1 at the same time, without necessarily providing any through-holes for forming through-hole conductors or via conductors in a core substrate such as a printed circuit board or a prepreg, nor without necessarily performing any particular processing for forming disposition space for the coil core 3 e.g. forming an opening for the disposition of the coil core 3, in contrast to the conventional coil component. Thus, it is possible to significantly simplify the manufacturing process of the coil component 1.

The dispositional relationship of the coil 5 provided in the coil component 1, such as the distance between each metal pin 6 or 7 and the coil core 3, is easily adjustable only by regulating an arrangement state of each metal pin 6 or 7 in the terminal assembly 100. When adjusting the positional relationship between each metal pin 6 or 7 and the coil core 3, there is no requirement for design change in a core substrate, a mold for resin sealing, and the like, and therefore it is possible to prevent an increase in manufacturing cost for the coil component 1 accompanying with the design change. Also, eliminating the need for providing the core substrate allows manufacturing the coil component 1 at very low cost and reducing the height of the coil component 1.

Meanwhile, when the wiring electrode patterns for connecting the corresponding metal pins 6 and 7 at their one end portions on the one main surface 2*a* of the resin insulating layer 2 and the wiring electrode patterns for connecting the corresponding metal pins 6 and 7 at their other end portions on the other main surface 2*b* are formed by etching metal films using a photolithography technique, each of the wiring electrode patterns can be formed so as to have a low resistance, just as with each metal pin 6 or 7. On the other hand, the formation of the wiring electrode patterns using the photolithography technique brings about an increase in manufacturing cost.

Forming the wiring electrode patterns for connecting the metal pins 6 and 7 by screen printing using a conductive paste allows a reduction in manufacturing cost, as compared with the use of the photolithography technique, but has the following problem. That is to say, since the resistivity of the wiring electrode pattern formed by the conductive paste to which conductivity is given by a filter metal contained therein is higher than that of each metal pin 6 or 7, the resistance of the entire coil electrode 4 is increased.

In this embodiment, the one-side wiring electrode patterns 8 and the other-side wiring electrode patterns 9 are each formed by laminating the plated electrode layer 8*b* or 9*b* by plating on the surface of the base electrode layer 8*a* or 9*a* functioning as a plating core. Thus, since an electric current flows through the plated electrode layers 8*b* and 9*b* having a low resistivity, the resistance of the entire wiring electrode pattern 8 or 9 is reduced. Also, especially when the coil component 1 is used in a high frequency (RF) circuit, since a high frequency current easily flows through the plated electrode layers 8*b* and 9*b* having a low resistivity formed on the surfaces of the wiring electrode patterns 8 and 9 by a skin effect, the resistance of each wiring electrode pattern 8 or 9 is further reduced.

The screen printing using the conductive paste can be performed at very low cost as compared with the photolithography technique, and the plating can be also performed at very low cost as compared with the photolithography technique. Thus, forming each wiring electrode pattern 8 or 9 using both of the screen printing and the plating, that is to say, forming the base electrode layers 8*a* and 9*a* by the screen printing and the plated electrode layers 8*b* and 9*b* by the plating allows a reduction in manufacturing cost of the coil component 1, while allowing a reduction in the resistance of each wiring electrode pattern 8 or 9.

In this embodiment, the base electrode layers 8*a* and 9*a* of the wiring electrode patterns 8 and 9 are each formed so as to cover part of the end surfaces of the metal pins 6 and 7 at its end portions, and the plated electrode layers 8*b* and 9*b* each cover the portions of the end surfaces not covered with the base electrode layer 8*a* or 9*a*. Thus, an area in which part of each end surface of each metal pin 6 or 7 connected to the wiring electrode pattern 8 or 9 is directly connected to the plated electrode layer 8*b* or 9*b* is formed, which has a lower resistivity than the base electrode layer 8*a* or 9*a* formed of the conductive paste. Therefore, it is possible to reduce the resistance of each wiring electrode pattern 8 or 9, and reduce the connection resistance between each wiring electrode pattern 8 or 9 and each metal pin 6 or 7. Thus, the resistance of the entire coil electrode 4 is reduced, and therefore it is possible to provide the coil component 1 including the toroidal coil 5 having good coil characteristics.

Note that, the above-described plated electrode layers 8*b* and 9*b* may have a two-layer structure by applying electroless plating and then applying electrolytic plating. The one-side wiring electrode pattern 8 and the other-side wiring electrode pattern 9 having a three-layer structure may be formed from the base electrode layer 8*a* and 9*a* having a single-layer structure and the plated electrode layer 8*b* and 9*b* (an electroless plating layer and an electrolytic plating layer) having a two-layer structure, respectively. This structure allows a further reduction in the resistance of the one-side wiring electrode patterns 8 and the other-side wiring electrode patterns 9. Also, the electrolytic plating layer can be formed stably.

Figure 24:
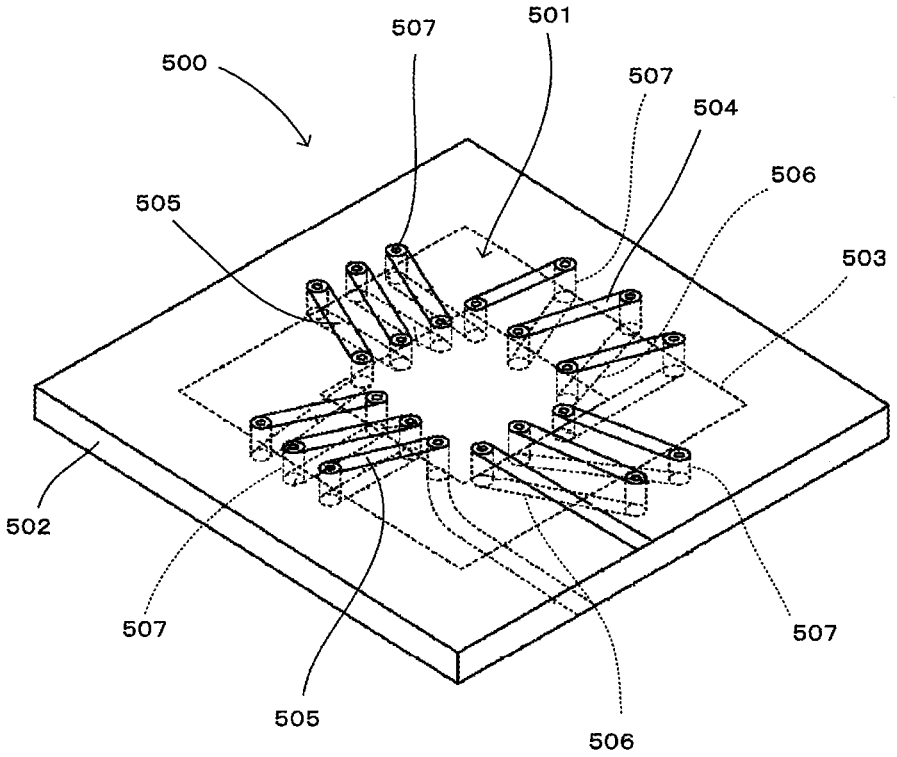
FIG. 24 is a drawing showing an example of a conventional coil component.

To form the conventional interlayer connection conductor 507 as shown in FIG. 24, a through-hole is formed in the core substrate 502 by laser beam machining, and plating is applied to or a conductive paste is charged into the inside of the through-hole. Thus, since the outer diameter of the interlayer connection conductor 507 is determined in accordance with the inner diameter of the through-hole, the inner diameter of the through-hole is required to be changed to change the outer diameter of the interlayer connection conductor 507. However, to change the inner diameter of the through-hole, conditions for laser beam machining have to be changed. Thus, since an operation for changing the outer diameter of the interlayer connection conductor 507 requires much effort, changing the outer diameter of the interlayer connection conductor 507 brings about an increase in manufacturing cost. Since the through-hole formed by the laser beam machining has a substantially conical shape due to the properties of a laser, it is difficult to make the interlayer connection conductor 507 have a constant outer diameter.

On the other hand, in this embodiment, the metal pins 6 and 7 form the wiring of the coil electrode 4 in the direction (metal pin direction) orthogonal to the direction of the winding axis of the coil electrode 4. Therefore, only by changing the diameter of each metal pin 6 or 7, the thickness of the wiring of the coil electrode 4 can be easily changed in the metal pin direction and the outer diameter can be made constant.

The coil characteristics of the coil 5 may deteriorate by the effects of the permittivity of the resin insulating layer 2 for covering the coil electrode 4 (metal pins 6 and 7). There are cases where gaps are formed between outer peripheral surface of each metal pin 6 or 7 and the resin insulating layer 2. Since the conventional interlayer connection conductor 507, as shown in FIG. 24, is formed by applying plating to or charging the conductive paste into the inside of the through-hole formed in the core substrate 502, it is difficult to form a gap between the interlayer connection conductor 507 and the inner surface of the through-hole.

However, a gap is easily formed between the outer peripheral surface of each metal pin 6 or 7 and the resin insulating layer 2 by, for example, applying wax or the like to the surface of each metal pin 6 or 7 supported in the terminal assembly 100. That is to say, as shown in FIGS. 8A and FIG. 8B, when thermosetting the resin insulating layer 2 for covering the metal pins 6 and 7 supported on the support layer 10, the wax applied to the surface of each metal pin 6 or 7 flows out and forms a gap between the outer peripheral surface of each metal pin 6 or 7 and the resin insulating layer 2. The formation of the gaps reduces the effect of the permittivity of the resin insulating layer 2, and hence improves the coil characteristics of the coil 5.

<Second Embodiment>

Figure 12:
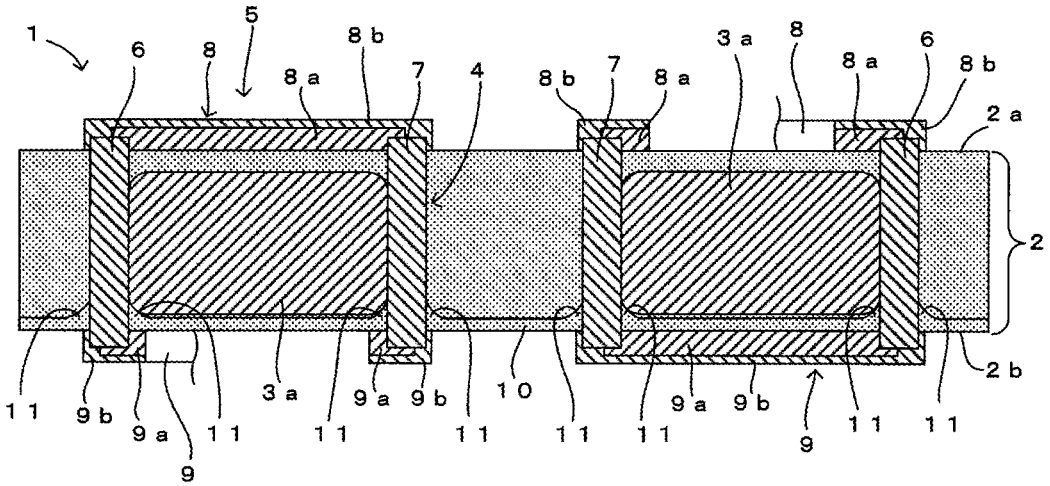
FIG. 12 is a sectional view of a coil component according to a second embodiment of the present disclosure.

A coil component according to a second embodiment of the present disclosure will be described with reference to FIG. 12. FIG. 12 is a sectional view showing the coil component according to the second embodiment of the present disclosure.

The difference between a coil component 1 according to this embodiment and the coil component 1 described with reference to FIGS. 1 and 2 is that, as shown in FIG. 12, the first metal pins 6 and the second metal pins 7 are arranged at the same distance as the width of a coil core 3*a* at a portion around which the coil electrode 4 is wound, and each metal pin 6 or 7 and the coil core 3*a* are disposed so as to be in contact with each other. In this embodiment, the metal pins 6 and 7 have the same outer diameter. The other structures are the same as those of the first embodiment, so the same components are indicated with the same reference numerals and the description thereof is omitted.

Depending on the material of the coil core 3*a* and the material of each metal pin 6 or 7, the contact between each metal pin 6 or 7 and the coil core 3*a* may facilitate trapping the magnetic field in the coil core 3*a*, and improve the coil characteristics. Thus, in this embodiment, the first metal pins 6 and the second metal pins 7 are arranged at the same distance as the width of the coil core 3*a* at the portion around which the coil electrode 4 is wound, and each metal pin 6 or 7 and the coil core 3*a* are disposed so as to be in contact with each other, thus serving to improve the coil characteristics of the coil 5 included in the coil component 1.

Meanwhile, in the conventional coil component 500 as shown in FIG. 24, the magnetic layer 503 having a predetermined shape and a predetermined thickness is embedded in the core substrate 502 in order to adjust the inductance of the coil 501. Thus, when forming the interlayer connection conductor 507 by plating or using a conductive paste, a through-hole for forming the interlayer connection conductor 507 is hard to form so as to be in contact with the magnetic layer 503 without necessarily changing the shape of the magnetic layer 503, owing to a notch and the like formed with the through-hole. Also, if space of the coil core is continued from the through-hole, it becomes difficult to apply plating to the through-hole or charge a conductive paste into the through-hole. Thus, the interlayer connection conductor 507 is hard to dispose so as to be in contact with the magnetic layer 503. On the other hand, in this embodiment, the metal pins 6 and 7 can be easily disposed so as to be in contact with the coil core 3*a* only by making the metal pins 6 and 7 in contact with the coil core 3*a*.

That is to say, according to this embodiment, the use of the metal pins 6 and 7 allows the zero gap disposition between the coil core 3*a* and the metal pin 6 or 7, in other words, allows disposing the coil core 3*a* and the metal pin 6 or 7 without necessarily any gap therebetween, in contrast to conventional column-shaped conductors having a via charging structure.

Note that, in this embodiment, the coil core 3*a* in which the width of the portion around which the coil electrode 4 is wound is the same as the arranged distance between each of the arranged first metal pins 6 and each of the arranged second metal pins 7 in the disposition step shown in FIG. 7A and FIG. 7B.

Also, as shown in FIG. 12, the edges of the coil core 3*a* are rounded in accordance with the shape of the outer peripheral surfaces of the support portions 11 of the support layer 10 in this embodiment, but the edges of the coil core 3*a* are not necessarily required to be rounded.

<Third Embodiment>

Figure 13:
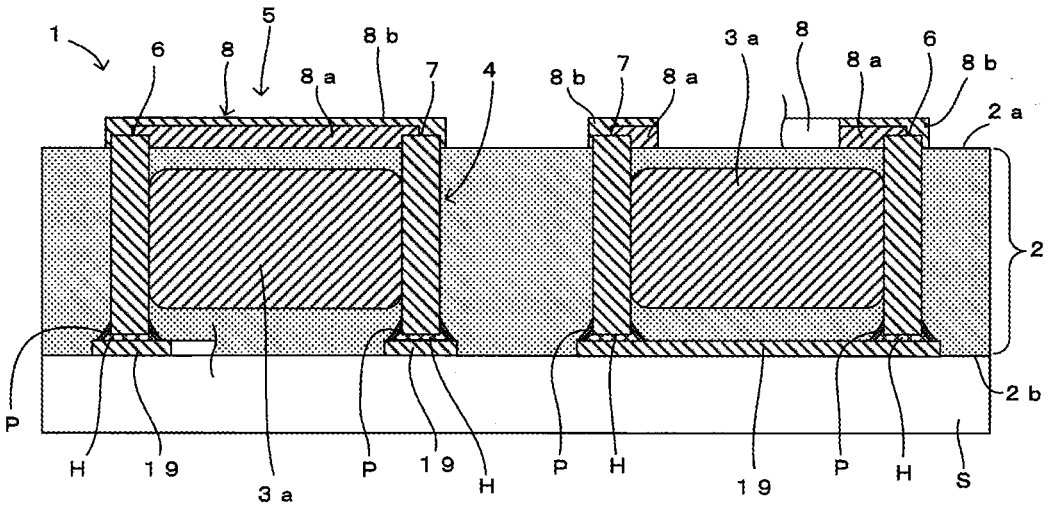
FIG. 13 is a sectional view of a coil component according to a third embodiment of the present disclosure.

A coil component according to a third embodiment of the present disclosure will be described with reference to FIG. 13. FIG. 13 is a sectional view showing the coil component according to the third embodiment of the present disclosure.

The difference between a coil component 1 according to this embodiment and the above-described coil component 1 according to the first and second embodiments is that, as shown in FIG. 13, the other side wiring electrode pattern 19 is formed on an insulating substrate S and each metal pin 6 or 7 is joined to the other-side wiring electrode pattern 19 at its other end portion with a joint member H such as solder. The joint member H is covered with a plating film P, and the plating film P is directly connected to the other-side wiring electrode pattern 19 and each metal pin 6 or 7. The other structures are the same as those of the first and second embodiments described above, so the same components are indicated with the same reference numerals and the description thereof is omitted.

The other-side wiring electrode pattern 19 is formed by, for example, etching a metal film (foil) made of a metal such as Cu, Au, Ag, Al, or a Cu alloy on the insulating substrate S using photolithography. In this embodiment, the other-side wiring electrode pattern 19 has approximately the same shape as the other-side wiring electrode pattern 9 formed in the other main surface 2*b* of the resin insulating layer 2 shown in FIG. 2 or FIG. 12 in a plan view, and is formed approximately in the same (overlapping) position.

Each metal pin 6 or 7 and the other-side wiring electrode pattern 19 are connected with the joint member H such as solder, and the joint member H is covered with the plating film P.

Note that, the surface of each metal pin 6 or 7 may be plated. As the joint member H, a conductive paste such as an Ag nano paste or a Cu nano paste may be adopted instead of solder. Likewise, the metal pins 6 and 7 may be connected to a one-side wiring electrode pattern formed on an insulating substrate S at their one end portions.

As described above, according to this embodiment, the joint member H such as solder has a relatively high resistivity, but the joint member H is covered with the plating film P. Thus, it is possible to reduce a resistance at a connection portion between each metal pin 6 or 7 and the other-side wiring electrode pattern 19. Also, since a high frequency current flows through the surface plating film P by a skin effect, this is especially effective in the case of dealing with the high frequency current flowing.

When each metal pin 6 or 7 and the other-side wiring electrode pattern 19 have a lower resistivity than the joint member H such as solder, the plating film P is directly connected to each metal pin 6 or 7 and the other-side wiring electrode pattern 19, thus allowing a further reduction in resistance.

<Fourth Embodiment>

A coil component according to a fourth embodiment of the present disclosure will be described with reference to FIGS. 14 to 16. Note that, FIG. 14 illustrates the schematic structure of the electrodes and the like or omits part of each column-shaped conductor for the sake of simplicity, and the detailed description thereof is omitted in the following description.

Figure 14:
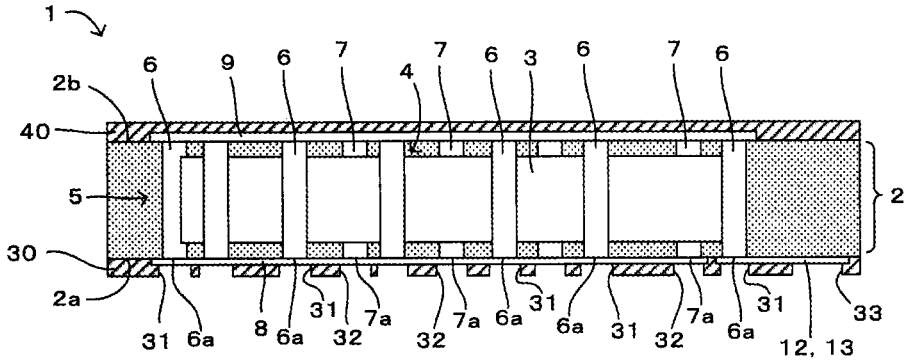
FIG. 14 is a sectional view of a coil component according to a fourth embodiment of the present disclosure.

The difference between a coil component 1 according to this embodiment and the above-described coil component 1 according to the first and second embodiments is that, as shown in FIG. 14, a resist layer 30 is laminated on the one main surface 2*a* of the resin insulating layer 2 so as to cover the one-side wiring electrode patterns 8, and a resist layer 40 is laminated on the other main surface 2*b* of the resin insulating layer 2 so as to cover the other-side wiring electrode patterns 9. In the following description, the difference from the first and second embodiments described above will be mainly focused. The other structures are the same as those of the first and second embodiments, so the same components are indicated with the same reference numerals and the description thereof is omitted.

Figure 15:
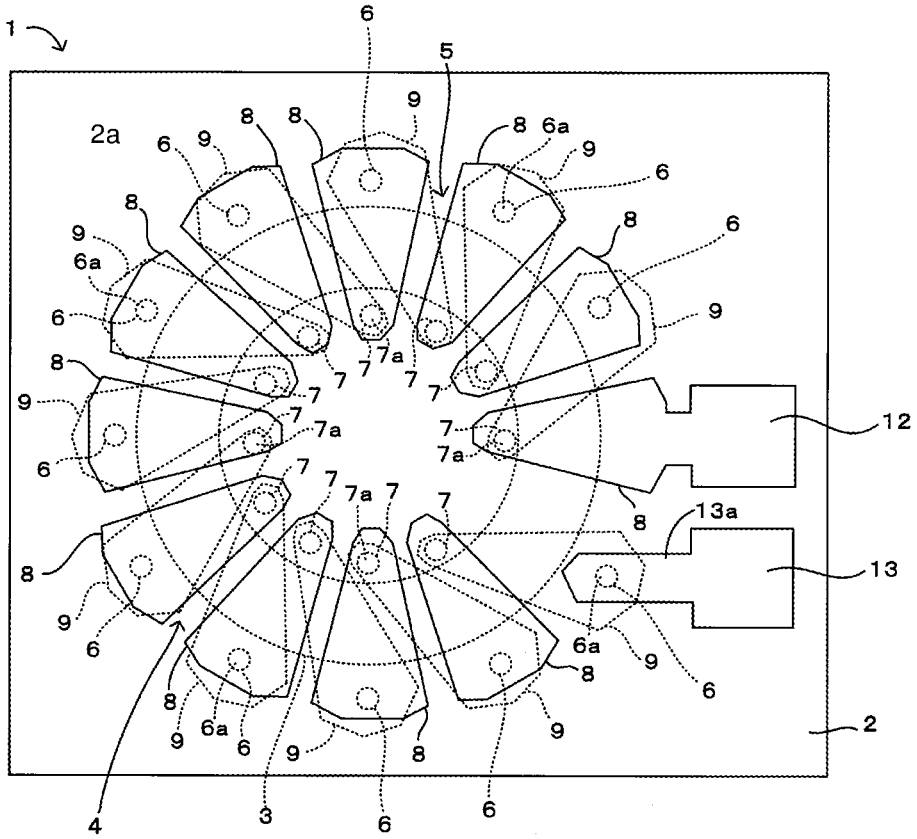
FIG. 15 is a bottom view of the coil component of FIG. 14 in one of main surfaces of a resin insulating layer.

As shown in FIG. 15, a rectangular land electrode 12 for connection to the outside is formed so as to extend from an outer end surface of the one-side wiring electrode pattern 8 that constitutes one end portion of the coil electrode 4, and another rectangular land electrode 13 for connection to the outside is formed so as to be connected to one end surface 6*a* of the metal pin 6 that constitutes the other end portion of the coil electrode 4 through the extending electrode 13*a*.

Figure 16:
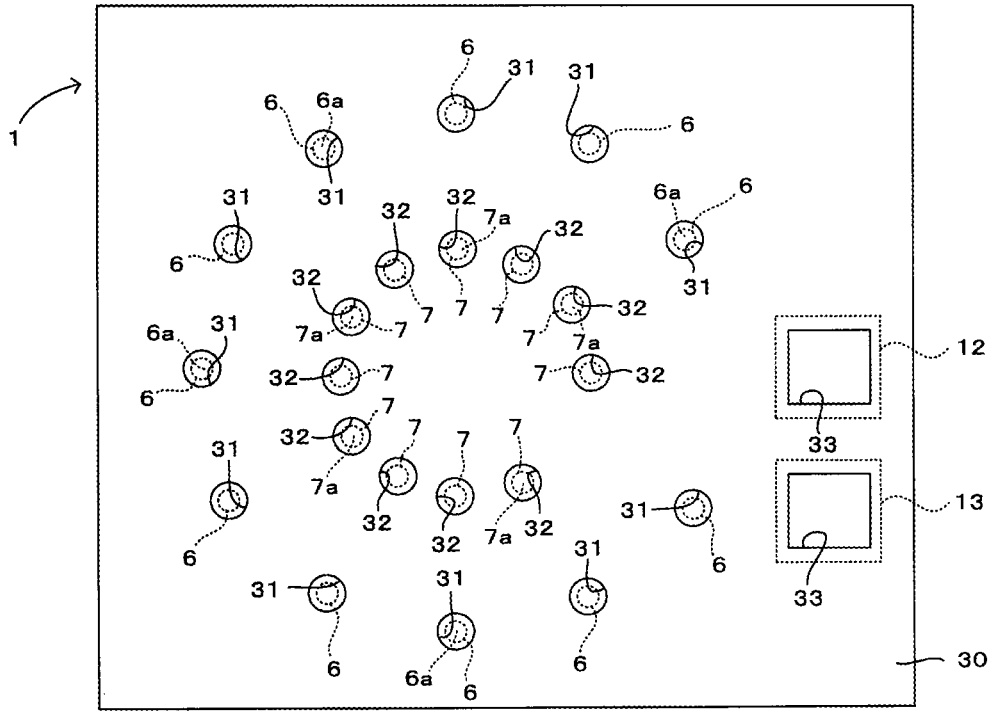
FIG. 16 is a bottom view of the coil component of FIG. 14.

Also, as shown in FIGS. 14 and 16, the resist layer 30 has a plurality of openings 31, 32, and 33. Each of the openings 31 is disposed so as to overlap a connection position between the end surface 6*a* of the first metal pin 6 and the one-side wiring electrode pattern 8 in a plan view (when viewed in a direction perpendicular to the end surface 6*a* of the first metal pin 6). Each of the openings 32 is disposed so as to overlap a connection position between one end surface 7*a* of the second metal pin 7 and the one-side wiring electrode pattern 8 in a plan view. Each of the openings 33 is disposed so as to overlap each of the land electrodes 12 and 13. Also, the opening 31 is formed larger in size than the end surface 6*a* of the first metal pin 6 that is disposed in a position overlapping the opening 31 in a plan view. The opening 32 is formed larger in size than the end surface 7*a* of the second metal pin 7 that is disposed in a position overlapping the opening 32 in a plan view.

According to this structure, the resist layer 30 prevents a short circuit between the one-side wiring electrode patterns 8. Heat tends to be generated in the connection position between the first or second metal pin 6 or 7 and the one-side wiring electrode pattern 8 when a large current flows therethrough, but providing the openings 31 and 32 in the positions overlapping the connection positions in a plan view improves heat dissipation. Therefore, it is possible to provide the coil component 1 having improved heat dissipation that can deal with a large current flowing, while preventing a short circuit between the one-side wiring electrode patterns 8.

The positions of the openings 31, 32, and 33 are just adjusted in accordance with the positions of the metal pins 6 and 7 and the land electrodes 12 and 13 during forming the resist layers 30 and 40 in the coil component 1, thus preventing an increase in manufacturing cost. Note that, in the coil component 1 shown in FIG. 13, if a resist layer 30 having a plurality of openings 31 and 32 is laminated on the one main surface 2*a* having the one-side wiring electrode patterns 8 thereon, the same effect as this embodiment can be obtained.

(Modification Examples)

A modification example will be described with reference to FIG. 17.

Figure 17:
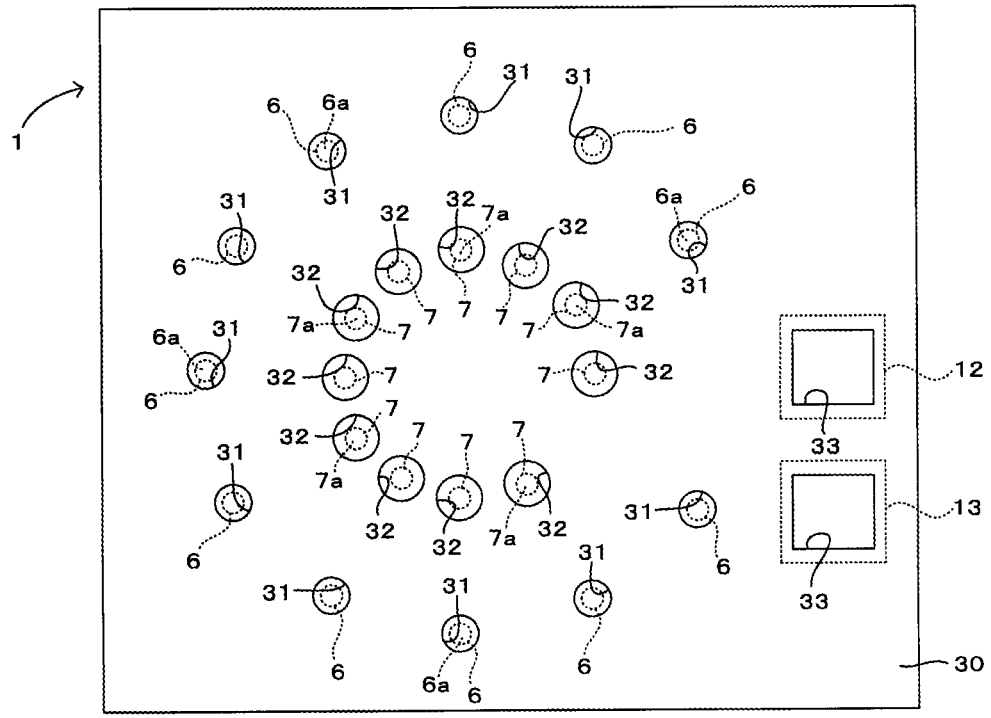
FIG. 17 is a bottom view of a modification example of the coil component of FIG. 14.

The difference between the modification example shown in FIG. 17 and the coil component 1 shown in FIG. 15 is that the opening 32 disposed in a position overlapping the end surface 7*a* of the second metal pin 7 in a plan view is larger in size than the opening 31 disposed in a position overlapping the end surface 6*a* of the first metal pin 6 in a plan view. Meanwhile, since the second metal pins 7 disposed on the side of the inner periphery of the coil core 3 are denser in general than the first metal pins 6 disposed on the side of the outer periphery of the coil core 3, heat tends to be generated. However, according to the structure of this embodiment, since the opening 32 disposed corresponding to the second metal pin 7 is made large in size, it is possible to improve heat dissipation in the vicinity of a connection position (a position where heat is apt to be generated) between the second metal pin 7 and the one-side wiring electrode pattern 8.

Another modification example will be described with reference to FIG. 18.

Figure 18:
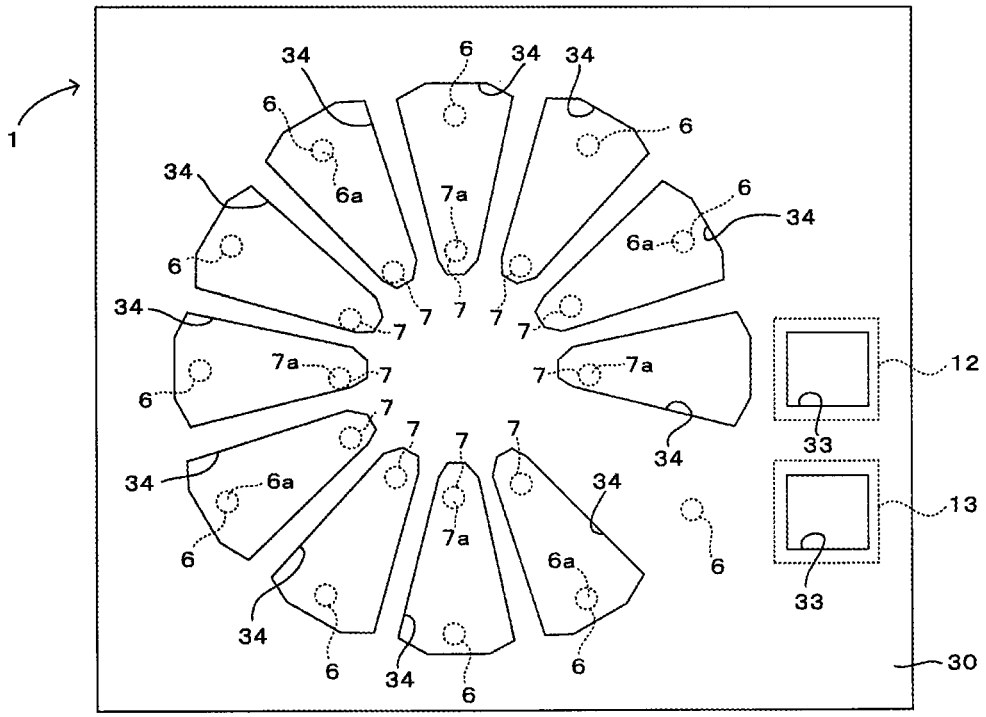
FIG. 18 is a bottom view of another modification example of the coil component of FIG. 14.

The difference between the modification example shown in FIG. 18 and the coil component 1 shown in FIG. 15 is that openings 34 having approximately the same shape as the one-side wiring electrode patterns 8 are formed in the resist layer 30 so as to overlap the entire one-side wiring electrode patterns 8 in a plan view. According to this structure, the openings 34 disposed so as to overlap the entire one-side wiring electrode patterns 8 allow further improvement in the heat dissipation of the coil component 1.

<Fifth Embodiment>

A coil component according to a fifth embodiment of the present disclosure will be described with reference to FIGS. 19 and 20. Note that, as shown in FIG. 19, openings 31 and 32 are formed corresponding to the first and second metal pins 6 and 7, respectively, but the openings 31 and 32 are described together in the following description for the sake of simplicity.

Figure 19:
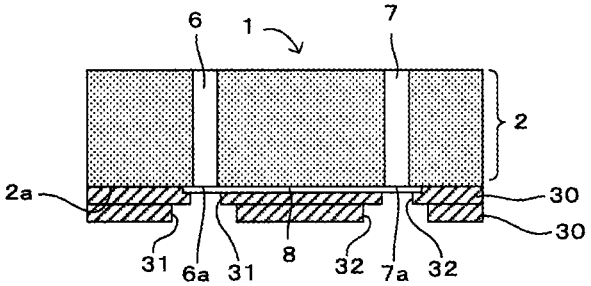
FIG. 19 is a sectional view of a portion of a coil component according to a fifth embodiment of the present disclosure.
Figure 20:
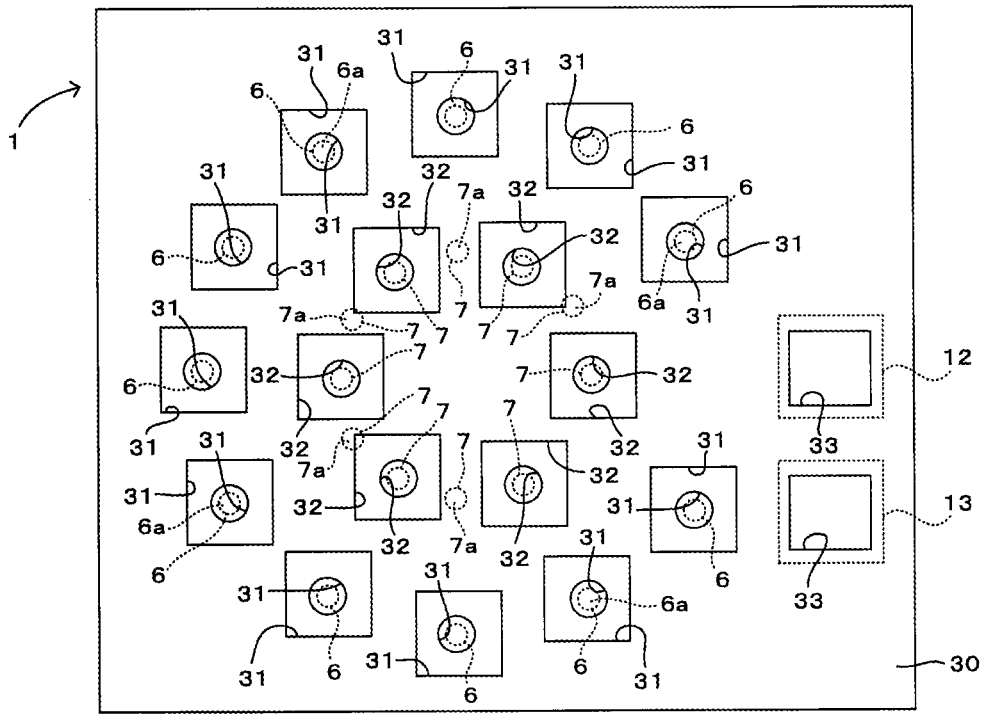
FIG. 20 is a bottom view of the coil component of FIG. 19.

The difference between the coil component 1 according to this embodiment and the coil component 1 described with reference to FIG. 14 is that, as shown in FIGS. 19 and 20, a plurality of resist layers 30 in which a plurality of openings 31, 32, and 33 are formed in the same positions in a plan view are laminated on the one main surface 2*a* of the resin insulating layer 2. In the following description, the difference from the fourth embodiment described above will be mainly focused. The other structures are the same as those of the fourth embodiment, so the same components are indicated with the same reference numerals and the description thereof is omitted.

As shown in FIGS. 19 and 20, the openings 31 and 32 formed in the outer resist layer 30 (on a lower side in FIG. 19) are larger in size than the openings 31 and 32 formed in the inner resist layer 30 (on an upper side in FIG. 19). Each of the outer (lower side) openings 31 and 32 is formed in a rectangular shape. The openings 32 are disposed corresponding to the plurality of alternate second metal pins 7 arranged at the inner side portions of the coil core 3 along the inner peripheral surface thereof.

According to this structure, since the openings 31 and 32 are formed so as to increase their size from the inner side (upper side) to the outer side (lower side), it is possible to dissipate heat generated in the coil component 1 with high efficiency. Also, as shown in FIG. 20, the distance between the second metal pins 7 arranged on the side of the inner periphery is narrower than the distance between the first metal pins 6 arranged on the side of the outer periphery, but the openings 32 are disposed corresponding to the plurality of alternate second metal pins 7, thus allowing increasing the size of the openings 32.

Note that, a resist layer 30 having three or more layers may be laminated on the one main surface 2*a* of the resin insulating layer 2. Also in this case, the openings 31 and 32 may be disposed so as to increase their size from the inner side (upper side) to the outer side (lower side) of the resist layer 30.

(Modification Example)

A modification example will be described with reference to FIG. 21.

Figure 21:
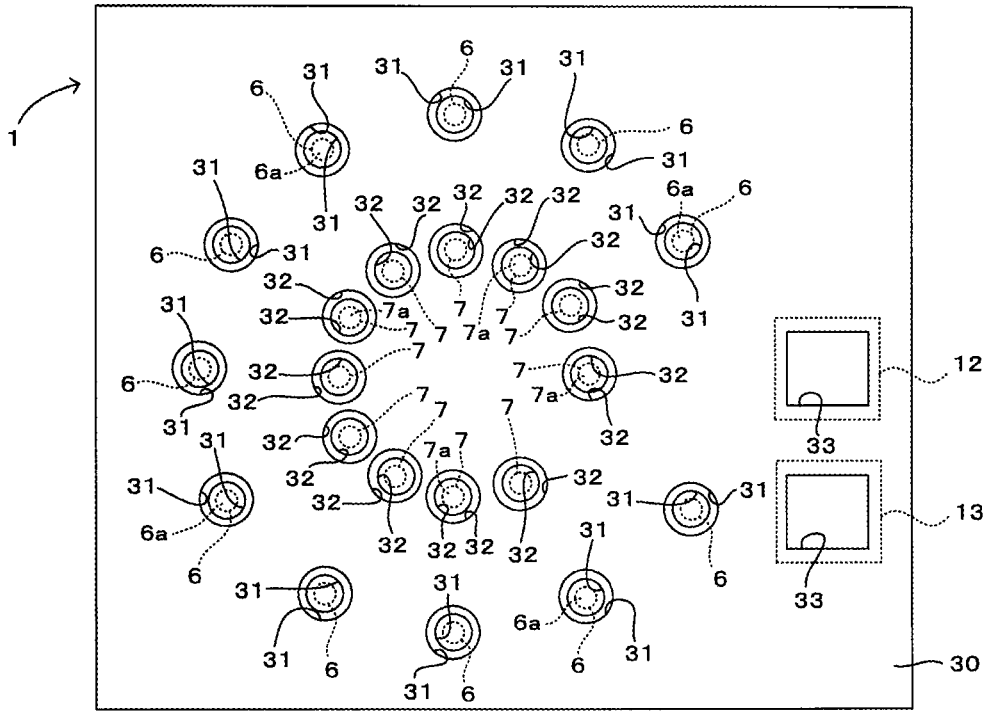
FIG. 21 is a bottom view of a modification example of the coil component of FIG. 19.

The difference between the modification example shown in FIG. 21 and the coil component 1 shown in FIG. 20 is that the openings 31 and 32 on the outer side (lower side) are formed in a circular shape. The opening 32 is provided for each second metal pin 7. This structure allows dissipating heat generated in the coil component 1 with high efficiency.

<Sixth Embodiment>

A coil module 200 according to a sixth embodiment of the present disclosure will be described with reference to FIG. 22. Just as with FIG. 14 described above, FIG. 22 illustrates the schematic structure of the electrodes and the like or omits part of each column-shaped conductor for the sake of simplicity, and the detailed description thereof is omitted in the following description. The coil module 200 includes the coil component 1 described in the first to fifth embodiments and a module substrate 201 on which the coil component 1 is mounted. Note that, the following description takes the coil module 200 in which the coil component 1 shown in FIG. 14 is mounted on the module substrate 201 as an example, but the number and type of the coil components 1 to be mounted on the module substrate 201 are not limited to the following contents. In the following description, the same components are indicated with the same reference numerals and the description thereof is omitted.

The module substrate 201 is constituted of a general multilayer substrate such as an LTCC (low-temperature cofired ceramic) multilayer substrate or a resin multilayer substrate made of a glass epoxy resin or the like. The above-described coil component 1, a DC-DC converter control IC (not shown), a chip-type component (not shown) including inductors and capacitors for forming e.g. a matching circuit and various filter circuits, and the like are mounted, if necessary, on a mounting surface 201*a* of the module substrate 201. Electrodes including land electrodes 202, dummy electrodes 203, outer connection terminals 204, wiring electrodes 205, and the like are formed in the module substrate 201 by a conductive material containing Cu, Ag, or the like.

The coil component 1 and the above-described various types of components are mounted on the land electrodes 202 for mounting the components provided on the mounting surface 201*a* of the module substrate 201, which is opposed to the resist layer 30 of the coil component 1, with a joint material H' such as solder, and are electrically connected to the plurality of outer connection terminals 204 formed on a rear surface 201*b* of the module substrate 201 through the wiring electrodes 205 provided in the module substrate 201. Note that, the land electrodes 202 are each formed on the mounting surface 201*a* in a position opposite to an opening 33 formed corresponding to each land electrode 12 or 13 for outer connection of the coil component 1. Each of the land electrodes 12 and 13 is connected to the land electrode 202 through the joint material H'. The module substrate 201 may be formed of a single layer substrate of various types.

The wiring electrode 205 includes an in-plane conductor and a via conductor formed, if necessary, in each of insulating layers that constitute the module substrate (multilayer substrate) 201. The coil component 1 and the various types of components provided in the module substrate 201 are mutually and electrically connected with the wiring electrodes 205. The wiring electrodes 205 appropriately form circuit elements such as capacitors and inductors for forming a matching circuit, various filter circuits, and the like.

Although simplified in FIG. 22, the dummy electrodes 203 are each formed on the mounting surface 201*a* in a position corresponding to each opening 31 or 32 of the coil component 1. The dummy electrode 203 is connected to the one-side wiring electrode pattern 8 disposed in the corresponding opening 31 or 32 with the joint material H'. Note that, the dummy electrode 203 may have approximately the same order of size as the corresponding opening 31 or 32. In this embodiment, the dummy electrodes 203 are not electrically connected to the other electrodes.

As described above, according to this embodiment, since heat generated in the coil component 1 is dissipated with high efficiency to the side of the module substrate 201 through the joint material H', it is possible to provide the coil module 200 having improved heat dissipation. Note that, in an example shown in FIG. 22, the resist layer 40, which is provided on the other main surface 2*b* of the resin insulating layer 2 of the coil component 1 and is not joined to the module substrate 201, can be eliminated.

Note that, the present disclosure is not limited to each of the above-described embodiments, but is variously changeable other than above within the scope of claimed subject matter, and the components described in the above embodiment can be arbitrarily combined. For example, the toroidal coil cores 3 and 3*a* are described in the above embodiments, but the shape of the coil core is not limited to toroidal type.

For example, coil cores of various shapes can be adopted such as a linear coil core 3*b* as shown in FIG. 23A and an approximately C-shaped coil core 3*c* as shown in FIG. 23B. Depending on a coil included in the coil component, coils having various functions, such as a common mode noise filter and a choke coil, can be composed.

Also, a resin layer may further be laminated on at least one of the main surfaces 2*a* and 2*b* of the resin insulating layer 2 described above. The coil component 1 may be embedded in the resin layer or another substrate.

In the above-described embodiments, the metal pins 6 and 7 are each protruded and exposed from the resin insulating layer 2 at their both end portions, but may be protruded and exposed from the resin insulating layer 2 at only their one end portion. Only the first metal pins 6 or the second metal pins 7 may be protruded and exposed from the resin insulating layer 2 at their end portions. Also, the metal pins 6 and 7 may be each protruded and exposed from the resin insulating layer 2 at only their both end surfaces. The thickness, length, and the like of each metal pin 6 or 7 may be arbitrarily changed in accordance with the structure of a required coil component.

The support layer 10 according to the above-described embodiments is not necessarily required. In the sealing step shown in FIG. 8A and FIG. 8B, a resin insulating layer 2 having a single layer structure may be formed by charging and thermosetting a resin in a state that the support layer 10 has not been thermoset. In the transfer step shown in FIG. 5A and FIG. 5B, each metal pin 6 or 7 does not necessarily penetrate through the support layer 10 at its other end portion.

A method for connecting the metal pins 6 and 7 at their corresponding one end portions (the structure of the first connection member) and a method for connecting the metal pins 6 and 7 at their corresponding other end portions (the structure of the second connection member) are not limited to the examples described above. The metal pins 6 and 7 may be connected at their corresponding end portions using a first connection member and/or a second connection member formed by wiring electrode patterns/a wiring electrode pattern formed by a photolithography technique. The metal pins 6 and 7 may be connected at their corresponding end portions using a first connection member and/or a second connection member formed with bonding wires/a bonding wire. The metal pins 6 and 7 can be connected at their corresponding end portions using any member. For example, the first connection member and/or the second connection member may be made of metal pins/a metal pin. In this case, the metal pin may be joined to the end portion of each metal pin 6 or 7 by ultrasonic bonding.

In the above-described fourth and fifth embodiments, the number, shape, and the like of the openings 31 and 32 of the resist layer 30 are not limited to the above examples. An optimal number of openings 31 and 32 having optimal shapes may be appropriately formed in the resist layer 30 depending on the structures of the coil component 1 and the coil module 200.

The insulating layer according to the present disclosure may be formed of a ceramic material or a glass material.

INDUSTRIAL APPLICABILITY

The present disclosure can be widely applied to a coil component including a coil in which a coil electrode is helically wound around a coil core embedded in a resin insulating layer, a coil module including the coil component, and a method for manufacturing the coil component.

REFERENCE SIGNS LIST

1 COIL COMPONENT
2 RESIN INSULATING LAYER (INSULATING LAYER)
2*a* ONE MAIN SURFACE
2*b* OTHER MAIN SURFACE
3, 3*a*, 3*b*, 3*c* COIL CORE
4 COIL ELECTRODE
5 COIL
6 FIRST METAL PIN
7 SECOND METAL PIN
6*a*, 7*a* ONE END PORTION
8 ONE-SIDE WIRING ELECTRODE PATTERN (FIRST CONNECTION MEMBER)
9, 19 OTHER-SIDE WIRING ELECTRODE PATTERN (SECOND CONNECTION MEMBER)
10 SUPPORT LAYER
11 SUPPORT PORTION
20 TRANSFER BODY
30 RESIST LAYER
31, 32 OPENING
21 RELEASE SHEET
100 TERMINAL ASSEMBLY
200 COIL MODULE
201 MODULE SUBSTRATE
201*a* MOUNTING SURFACE
203 DUMMY ELECTRODE
G GAP
H JOINT MEMBER
H' JOINT MATERIAL
P PLATING FILM
R PREDETERMINED AREA

The invention claimed is:

1. A coil component comprising:

a coil including: a coil core embedded in an insulating layer; and a coil electrode provided in the insulating layer so as to be helically wound around the coil core, wherein the coil electrode includes:

a plurality of first metal pins disposed across a direction of a winding axis of the coil electrode and arranged on one side of the coil core;

a plurality of second metal pins disposed across the direction of the winding axis of the coil electrode and arranged on the other side of the coil core, such that the coil core is disposed between the arrangement of the first metal pins and the arrangement of the second metal pins;

a plurality of first connection members each for connecting the first metal pin and the second metal pin paired with each other at one end portions of the first metal pins and the second metal pins;

a plurality of second connection members each for connecting the first metal pin and the second metal pin that is adjoining on one side to the second metal pin paired with the first metal pin at other end portions of the first metal pins and the second metal pins;

the insulating layer includes a support layer through which the first metal pins and the second metal pins penetrate at the other end portions;

the support layer includes fillet-shaped support portions each provided between a peripheral surface of the other end portion of each of the first metal pins and the second metal pins and the support layer; and the width of the coil core is narrower than the distance between the arrangement of the first metal pins and the arrangement of the second metal pins, and a gap is provided between each of the first metal pins and the second metal pins and the coil core by contact of an edge of the coil core with an outer peripheral surface of the support portion.

2. The coil component according to claim 1, wherein the first metal pins and the second metal pins are disposed so as to be protruded from one main surface of the insulating layer at the one end portions of the first metal pins and the second metal pins, and so as to be protruded from the other main surface of the insulating layer at the other end portions of the first metal pins and the second metal pins;

the first connection members are provided on the one main surface of the insulating layer; and the second connection members are provided on the other main surface of the insulating layer.

3. The coil component according to claim 1, wherein the first metal pins and the second metal pins are arranged such that the distance between the arrangement of the first metal pins and the arrangement of the second metal pins is equal to the width of the coil core, so that each of the first metal pins and the second metal pins is in contact with the coil core.

4. The coil component according to claim 1, wherein a gap is provided between an outer peripheral surface of each of the first metal pins and/or the second metal pins and the insulating layer.

5. The coil component according to claim 1, wherein the first metal pin and/or the second metal pin are/is connected to the first connection members and/or the second connection member with a joint member, and the joint member is covered with a plating film, and the plating film is directly connected to the first metal pin and/or the second metal pin, and to the first connection member and/or the second connection member.

6. The coil component according to claim 1, wherein the coil has the coil core that is toroidal in shape, and the first metal pins are arranged on one side, that is, at outer side portions of the coil core, while the second metal pins are arranged on the other side, that is, at inner side portions of the coil core.

7. The coil component according to claim 6, wherein the second metal pin has a smaller diameter than the first metal pin; and the first connection member and/or the second connection member are/is provided in a tapered shape that becomes narrower as it approaches the second metal pin.

8. A coil component comprising:

a coil including: a coil core embedded in an insulating layer; and a coil electrode provided in the insulating layer so as to be helically wound around the coil core, wherein the coil electrode includes:

a plurality of first metal pins disposed across a direction of a winding axis of the coil electrode and arranged on one side of the coil core;

a plurality of second metal pins disposed across the direction of the winding axis of the coil electrode and arranged on the other side of the coil core, such that the coil core is disposed between the arrangement of the first metal pins and the arrangement of the second metal pins;

a plurality of first connection members each for connecting the first metal pin and the second metal pin paired with each other at one end portions of the first metal pins and the second metal pins;

a plurality of second connection members each for connecting the first metal pin and the second metal pin that is adjoining on one side to the second metal pin paired with the first metal pin at other end portions of the first metal pins and the second metal pins;

the first metal pins and the second metal pins are each disposed so as to be exposed from the one main surface of the insulating layer at the one end portion, and so as to be exposed from the other main surface of the insulating layer at the other end portion;

the first connection members are provided on the one main surface of the insulating layer;

the second connection members are provided on the other main surface of the insulating layer;

a resist layer that is laminated on the one main surface of the insulating layer so as to cover the first connection members is further provided; and the resist layer has a plurality of openings each of which is disposed in a position overlapping a connection position between one end surface of the first metal pin or the second metal pin and the first connection member in a plan view, and each of the plurality of openings is larger in size than the one end surface of the first metal pin or the second metal pin disposed in a position overlapping the opening in a plan view.

9. The coil component according to claim 8, wherein the opening disposed in a position overlapping the one end surface of the second metal pin in a plan view is larger in size than the opening disposed in a position overlapping the one end surface of the first metal pin in a plan view.

10. The coil component according to claim 8, wherein the opening is provided so as to overlap the entire first connection member in a plan view.

11. The coil component according to claim 8, wherein a plurality of the resist layers among which the plurality of openings are provided in the same positions in a plan view are laminated on the one main surface of the insulating layer; and the opening provided in the outer resist layer is larger in size than the opening provided in the inner resist layer.

12. The coil component according to claim 11, wherein the opening is disposed corresponding to the plurality of alternate second metal pins.

13. A coil module comprising:

the coil component according to claim 8; and a module substrate on which the coil component is mounted, wherein dummy electrodes are provided on a mounting surface of the module substrate that is opposite to the resist layer of the coil component, in positions corresponding to each of the openings; and the dummy electrode and the first connection member disposed in the corresponding opening are connected with a joint member.

* * * * *